US007571588B2

(12) United States Patent
Sambuca, Jr. et al.

(10) Patent No.: US 7,571,588 B2
(45) Date of Patent: Aug. 11, 2009

(54) CASE SEALER WITH WASH-DOWN, KNOCKDOWN, AND REVERSIBLE CAPABILITIES

(75) Inventors: Anthony J. Sambuca, Jr., Honesdale, PA (US); Richard E. Millon, Honesdale, PA (US); Dennis P. Wilk, Hughestown, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/452,341

(22) Filed: Jun. 14, 2006

(65) Prior Publication Data

US 2007/0289256 A1 Dec. 20, 2007

(51) Int. Cl.
*B65B 7/20* (2006.01)
*B65B 51/18* (2006.01)
*B31B 1/72* (2006.01)

(52) U.S. Cl. ..... 53/378.3; 53/377.2; 53/117

(58) Field of Classification Search ..... 53/484, 53/485, 387.3, 377.2, 383.1, 37.3, 383.18; 211/182, 190; 493/116, 117; 403/381, 360
See application file for complete search history.

(56) References Cited

U.S. PATENT DOCUMENTS 2,769,525 A * 11/1956 Herscovitch ..... 198/300
3,092,200 A * 6/1963 Chambers ..... 180/9.22
4,041,675 A * 8/1977 Loveland et al. ..... 53/76
4,079,577 A * 3/1978 Ulrich et al. ..... 53/377.2
4,392,911 A * 7/1983 Ulrich et al. ..... 156/468
4,525,980 A * 7/1985 Ulrich et al. ..... 53/377.2
4,537,649 A * 8/1985 Ulrich et al. ..... 156/355
4,542,616 A * 9/1985 Ulrich et al. ..... 53/136.4
4,545,175 A 10/1985 Beckett
4,545,176 A * 10/1985 Marchetti ..... 53/76
4,581,876 A * 4/1986 Williams et al. ..... 53/484
4,584,818 A 4/1986 Plaskett
4,627,217 A 12/1986 Plaskett
4,656,810 A 4/1987 Plaskett
4,658,563 A * 4/1987 Lissoni ..... 53/136.4
4,936,816 A 6/1990 Blumle et al.
4,938,442 A * 7/1990 Mastrodicasa ..... 248/250
4,955,177 A * 9/1990 Lerner et al. ..... 53/136.4
5,102,382 A 4/1992 Center et al.
5,120,293 A 6/1992 Franklin
5,234,398 A 8/1993 Larsen
5,352,178 A 10/1994 Pazdernik (Continued)

*Primary Examiner*—Paul R Durand
(74) *Attorney, Agent, or Firm*—Law Offices of Steven W. Weinrieb

(57) ABSTRACT

A case sealer assembly comprises frame members which are fabricated from round tubular or rod stock. In this manner, water will tend to readily drain from such structures and not tend to accumulate upon such structures in order to prevent the harboring or growth of bacteria within such regions of the assembly. In addition, the case sealer assembly has knock-down capabilities as a result of comprising a plurality of subassemblies which are readily disassembled from one another in order to facilitate the cleaning of the various sub-assemblies as well as the overall case sealer assembly, and in addition, to facilitate maintenance or replacement of component parts. Various subassemblies of the case sealer assembly are also reversibly mounted upon the main tube frame subassembly so as to effectively render the case sealer assembly operative in either one of two different directions as may be preferred in accordance with particular manufacturing plant processing lines.

22 Claims, 10 Drawing Sheets

U.S. PATENT DOCUMENTS 5,363,733 A * 11/1994 Baird et al. ..... 83/786
5,415,613 A 5/1995 McGrath
5,454,776 A 10/1995 Ulrich et al.
5,826,408 A 10/1998 Ford
5,868,308 A 2/1999 Briand
5,876,319 A 3/1999 Holton
5,924,968 A 7/1999 Odenthal
6,067,773 A * 5/2000 Le ..... 53/387.2
6,309,335 B1 10/2001 Holton
6,599,225 B2 7/2003 Ammons et al.
6,622,461 B2 9/2003 Gambetti
6,764,436 B1 7/2004 Mazurek

* cited by examiner

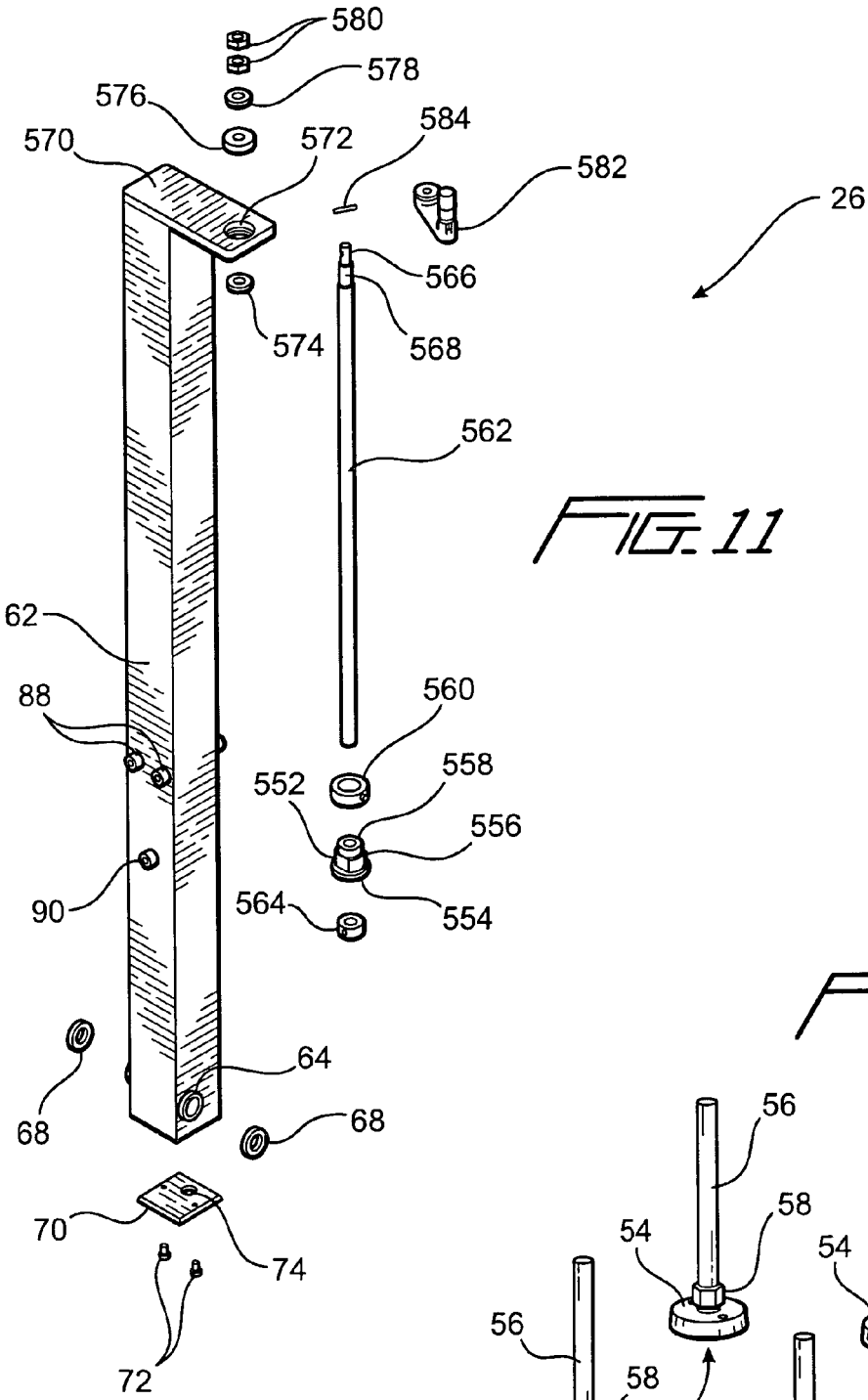
FIG. 11
FIG. 5
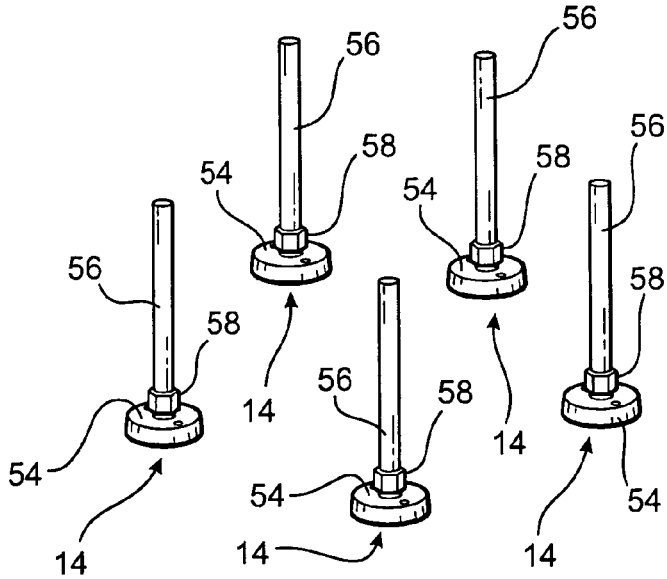

CASE SEALER WITH WASH-DOWN, KNOCKDOWN, AND REVERSIBLE CAPABILITIES

FIELD OF THE INVENTION

The present invention relates generally to a case sealer assembly or apparatus, and more particularly to a new and improved case sealer assembly or apparatus wherein the same is uniquely structured so as to effectively eliminate or minimize areas or regions of the assembly or apparatus which would otherwise accumulate water, during, for example, a wash-down process, so as to, in turn, effectively eliminate or minimize the potential for such areas or regions of the assembly or apparatus to harbor bacteria or to foster the growth thereof, wherein the new and improved case sealer assembly or apparatus is also uniquely structured so as to exhibit knockdown capabilities whereby the various subassemblies or components of the case sealer assembly or apparatus are relatively easy to remove from the overall case sealer assembly or apparatus in order to facilitate the cleaning of the various subassemblies or components of the case sealer assembly or apparatus, and wherein further, the new and improved case sealer assembly or apparatus is also capable of having its various subassemblies positionally reversed such that the new and improved case sealer assembly or apparatus is able to conduct or process cases through the assembly or apparatus in either one of two opposite directions. It is lastly noted that the case sealer assembly or apparatus of the present invention is uniquely structured for use within the food industry in order to meet and satisfy various guidelines and specifications that are periodically promulgated by means of various private and governmental agencies or organizations, such as, for example, the American Meat Institute (AMI), the Food and Drug Administration (FDA), and the Baking Industry Sanitation Standards Committee (BISSC).

BACKGROUND OF THE INVENTION

In connection with various equipment which is to be utilized for processing, packing, storing, and transporting food products, the food industry often uses guide lines and specifications which are periodically promulgated by means of various different private organizations, institutes, or the like, as well as state or federal governmental agencies, such as, for example, the American Meat Institute (AMI), the Food and Drug Administration (FDA), and the Baking Industry Sanitation Standards Committee (BISSC), in order to ensure that the food is, and remains, sanitary from the grower or manufacturer to the consumer retail outlet. More particularly, in connection with cases or cartons utilized for packing or containing the various different food products, it is desirable to effectively eliminate or minimize areas or regions of the case or carton sealer assembly or apparatus which would otherwise accumulate water, during, for example, a wash-down process, so as to, in turn, effectively eliminate or minimize the potential for such areas or regions of the case or carton sealer assembly or apparatus to harbor bacteria or to foster the growth thereof. Along these lines, it is therefore desirable that the case or carton sealer assembly, apparatus or equipment comprises structure which effectively readily sheds or drains water, or which effectively resists the accumulation of water, and in addition, is capable of being readily disassembled so as to facilitate the cleaning thereof. Still yet further, it is important in connection with the operation of such case or carton sealer assemblies or apparatus that the same effectively be reversible so as to be capable of processing or sealing cases or cartons in either one of two oppositely oriented directions.

A need therefore exists in the art for a new and improved case sealer assembly or apparatus wherein the same would be uniquely structured so as to effectively eliminate or minimize areas or regions of the assembly or apparatus which would otherwise accumulate water, during, for example, a wash-down process, so as to, in turn, effectively eliminate or minimize the potential for such areas or regions of the assembly or apparatus to harbor bacteria or to foster the growth thereof. In addition, a need exists in the art for a new and improved case sealer assembly or apparatus wherein the same would also be uniquely structured so as to exhibit knockdown capabilities whereby the various subassemblies or components of the case sealer assembly or apparatus would be relatively easy to remove from the overall case sealer assembly or apparatus in order to facilitate the cleaning of the various subassemblies or components of the case sealer assembly or apparatus. Still further, a need exists in the art for a new and improved case sealer assembly or apparatus which is also capable of having its various subassemblies positionally reversed such that the new and improved case sealer assembly or apparatus would be able to conduct or process cases within and through the assembly or apparatus in either one of two opposite directions.

SUMMARY OF THE INVENTION

The foregoing and other objectives are achieved in accordance with the teachings and principles of the present invention through the provision of a new and improved case sealer assembly or apparatus which comprises, for example, frame members which are fabricated from round tubular or rod stock. In this manner, water will tend to readily drain from such structures or at least tend not to accumulate upon such structure in order to prevent the harboring of bacteria within such regions of the assembly or apparatus, or to prevent or foster the growth of bacteria within such regions of the case sealer assembly or apparatus. In addition, the new and improved case sealer assembly or apparatus has knockdown capabilities, as a result of comprising a plurality of subassemblies which are readily disassembled from one another, in order to facilitate the cleaning of the various subassemblies as well as the overall case sealer assembly or apparatus. It is lastly noted that various subassemblies of the new and improved case sealer assembly or apparatus are reversibly mounted upon the main tube frame subassembly of the case sealer assembly or apparatus so as to effectively render the case sealer assembly or apparatus operative in either one of two different directions.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 5 is an enlarged perspective detailed view of the plurality of case sealer leveler mechanisms of the new and improved case sealer assembly as disclosed within FIG. 2;

FIG. 11 is an enlarged and exploded perspective detailed view of the mast subassembly of the new and improved case sealer assembly as disclosed within FIG. 2.

DETAILED DESCRIPTION OF THE PREFERRED EMBODIMENT

Figure 1:
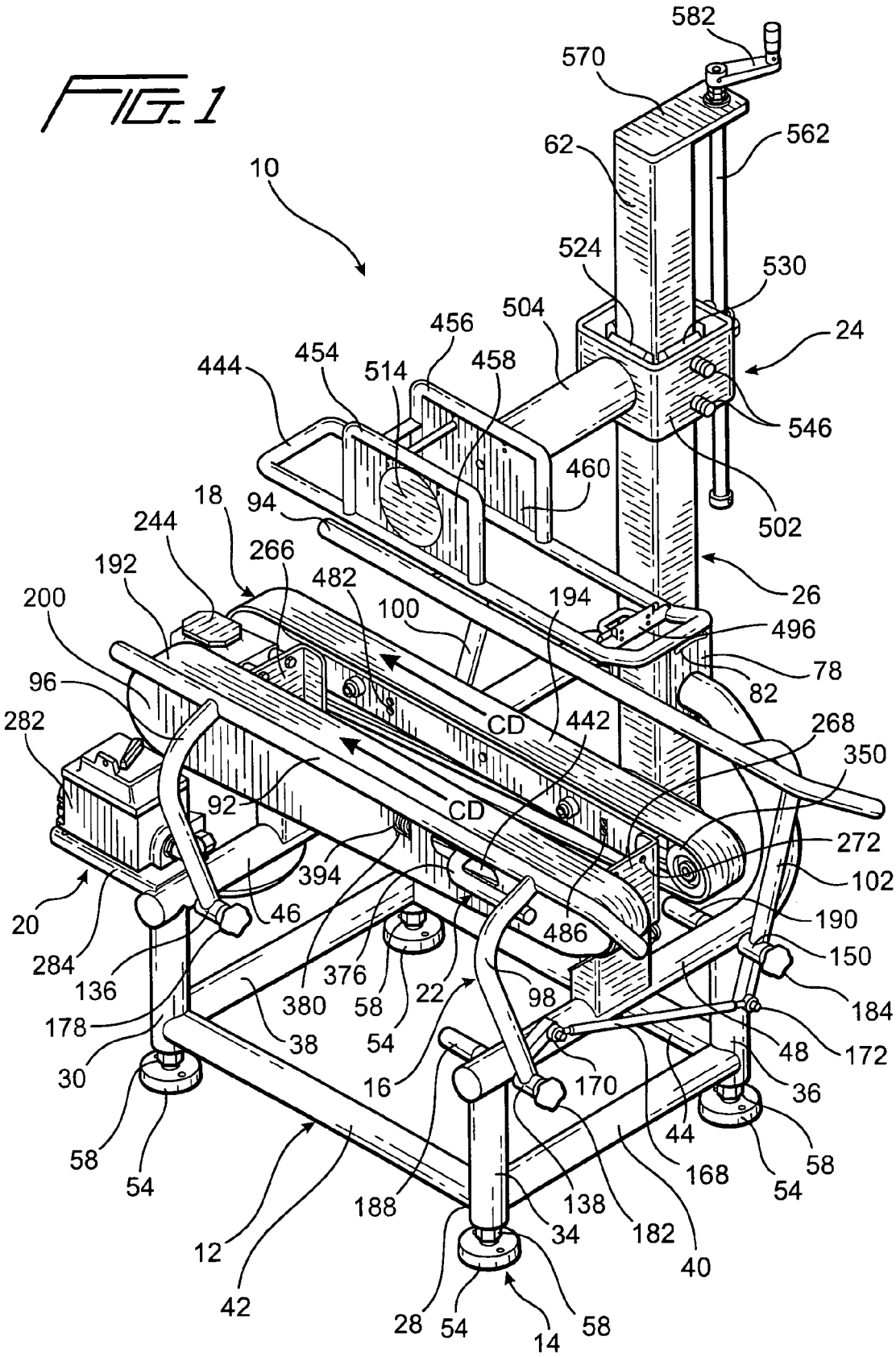
FIG. 1 is an assembled perspective view of a new and improved case sealer assembly which has been constructed in accordance with the principles and teachings of the present invention such that the new and improved case sealer assembly has wash-down, knockdown, and reversible capabilities.
Figure 2:
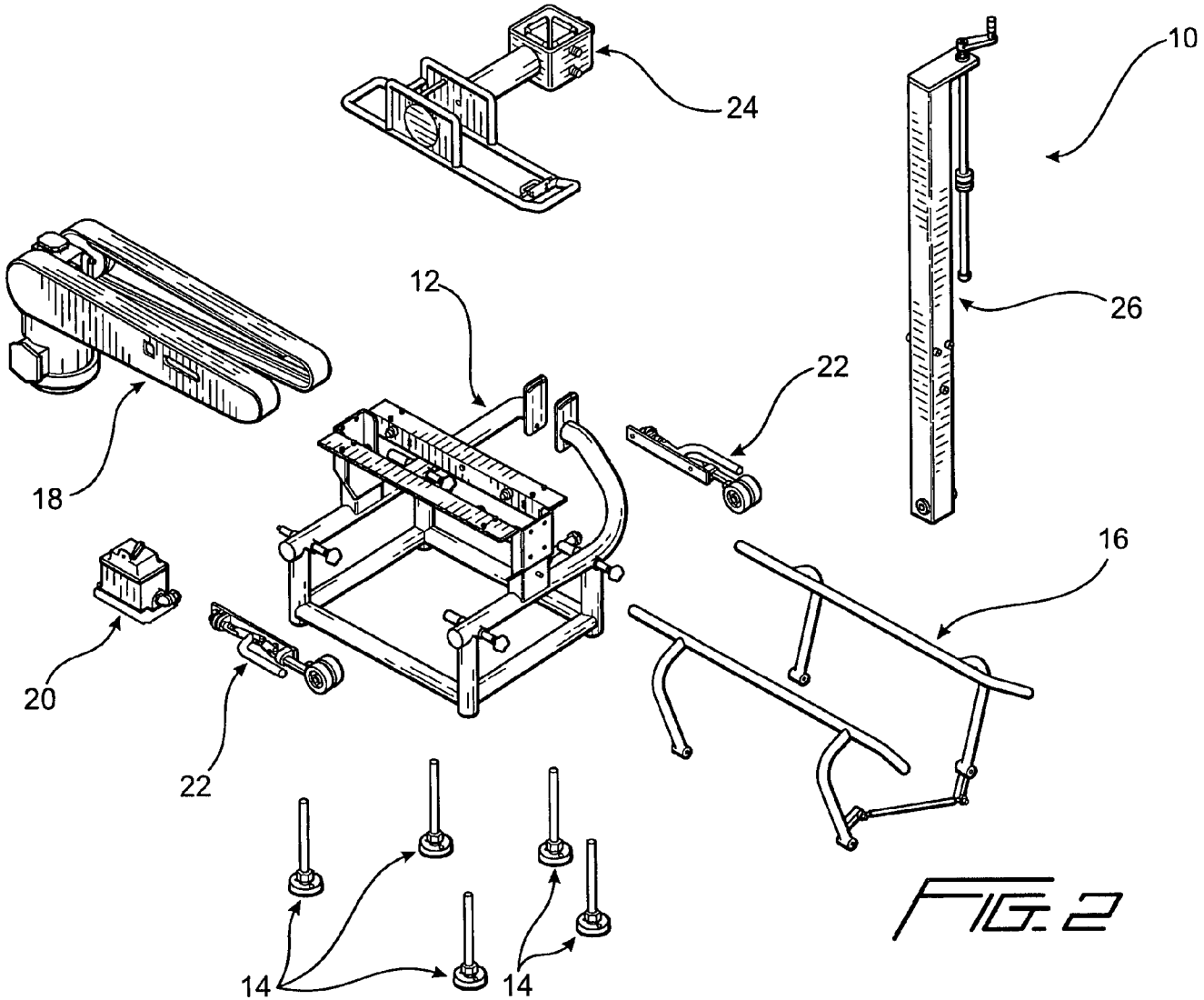
FIG. 2 is an exploded perspective view of the new and improved case sealer assembly as disclosed within FIG. 1 wherein the various subassemblies comprising the new and improved case sealer assembly, such as, for example, a frame tube subassembly, a plurality of case sealer leveler mechanisms, a side rail subassembly, a belt drive subassembly, a motor starter subassembly, a pair of tension roller bracket subassemblies, a head subassembly, and a mast subassembly, are disclosed.

Referring now to the drawings, and more particularly to FIGS. 1 and 2 thereof, a new and improved case sealer assembly or apparatus, which has been constructed in accordance with the principles and teachings of the present invention, is disclosed and is generally indicated by the reference character 10. More particularly, as can best be appreciated from FIG. 2, it is seen that the new and improved case sealer assembly or apparatus 10 comprises a plurality of components or subassemblies, such as, for example, a frame tube subassembly that is generally indicated by the reference character 12, a plurality of case sealer leveler mechanisms each one of which is generally indicated by the reference character 14, a side rail subassembly which is generally indicated by the reference character 16, a conveyor belt drive subassembly which is generally indicated by the reference character 18, a motor starter subassembly which is generally indicated by the reference character 20, a pair of tension roller bracket subassemblies which are generally indicated by the reference characters 22,22, a head subassembly which is generally indicated by the reference character 24, and a mast subassembly which is generally indicated by the reference character 26, all of which will be discussed and described more in detail hereinafter in connection with FIGS. 3-11. What is noted at this juncture is that the new and improved case sealer assembly or apparatus 10 is capable of being knocked down, as a result of the various components or subassemblies 12-26 being adapted to be easily disconnected or disassembled from each other, such that the various areas or regions of the case sealer assembly or apparatus 10, which would otherwise accumulate water, during, for example, a wash-down process or procedure, can be thoroughly cleaned and dried so as to effectively minimize or eliminate the potential for such areas or regions of the case sealer assembly or apparatus 10 to harbor bacteria or to foster the growth thereof, and subsequently, the various components or subassemblies 12-26 of the case sealer assembly or apparatus 10 can be readily and easily reconnected or reassembled with respect to each other. In addition, the construction of the case sealer assembly or apparatus 10 also enables some of the components or subassemblies 16-24 to be reversibly mounted upon, or with respect to, the frame tube subassembly 12 so as to enable the new and improved case sealer assembly or apparatus 10 to process cases in either one of two different conveyance directions in order to effectively accommodate particular processing flow lines inherent to specific manufacturing or processing plants.

Continuing further, then, the frame tube subassembly 12 of the new and improved case sealer assembly or apparatus 10 will be described first, with particular additional reference being made to FIGS. 3 and 4, in view of the fact that the frame tube subassembly 12 comprises, in effect, the foundation or support base of the new and improved case sealer assembly or apparatus 10 upon which all of the other components or subassemblies 14-26 of the case sealer assembly or apparatus 10 are adapted to be mounted and supported. It is also to be noted that the other components or subassemblies 14-26 of the case sealer assembly or apparatus 10 will be described in conjunction with the description of the tube frame subassembly 12 when, for example, that portion of the tube frame subassembly 12, upon which the particular component or subassembly 14-26 is adapted to be mounted or supported, is being described.

Figure 3:
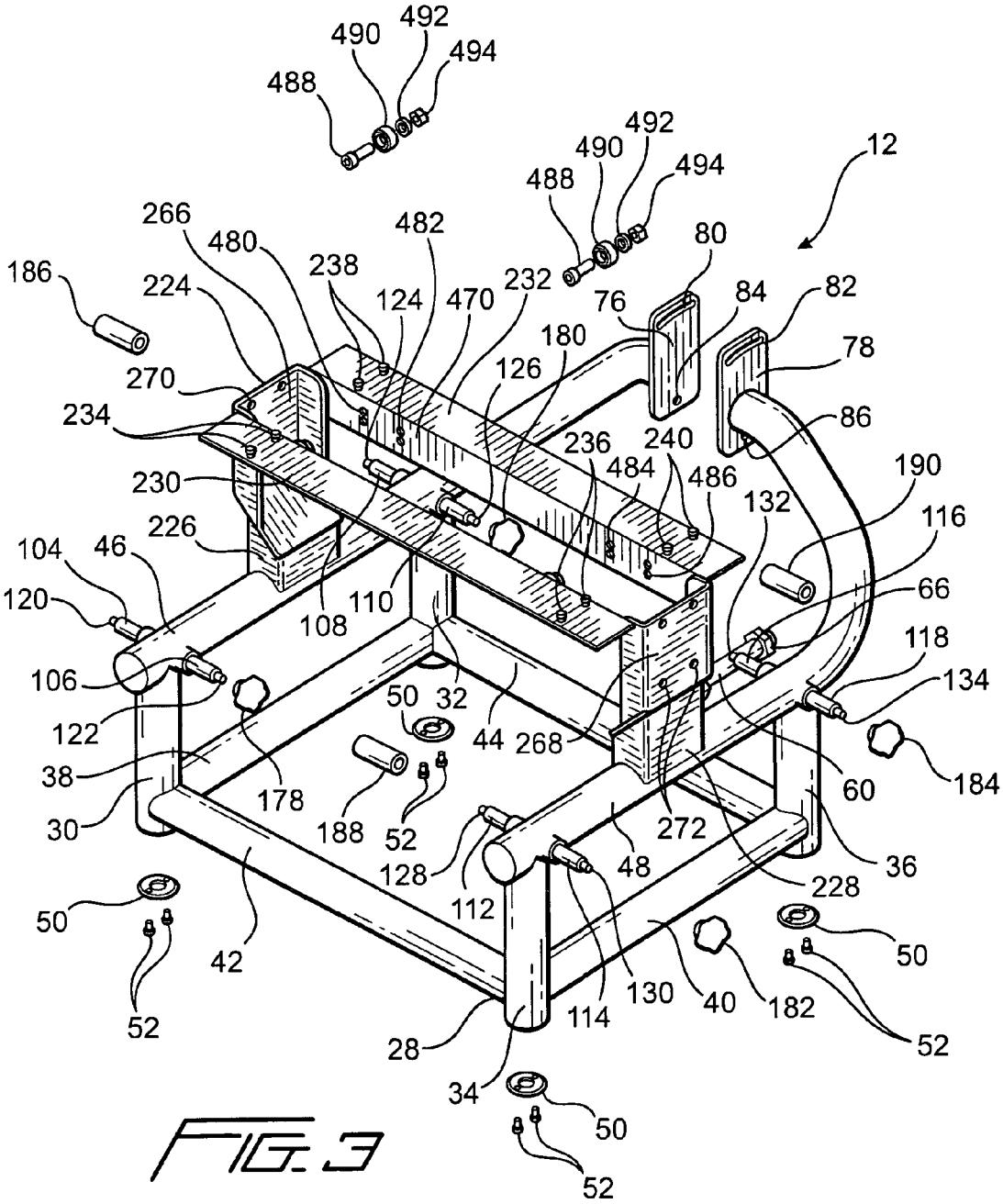
FIG. 3 is an enlarged and exploded front perspective detailed view of the frame tube subassembly of the new and improved case sealer assembly as disclosed within FIG. 2.
Figure 4:
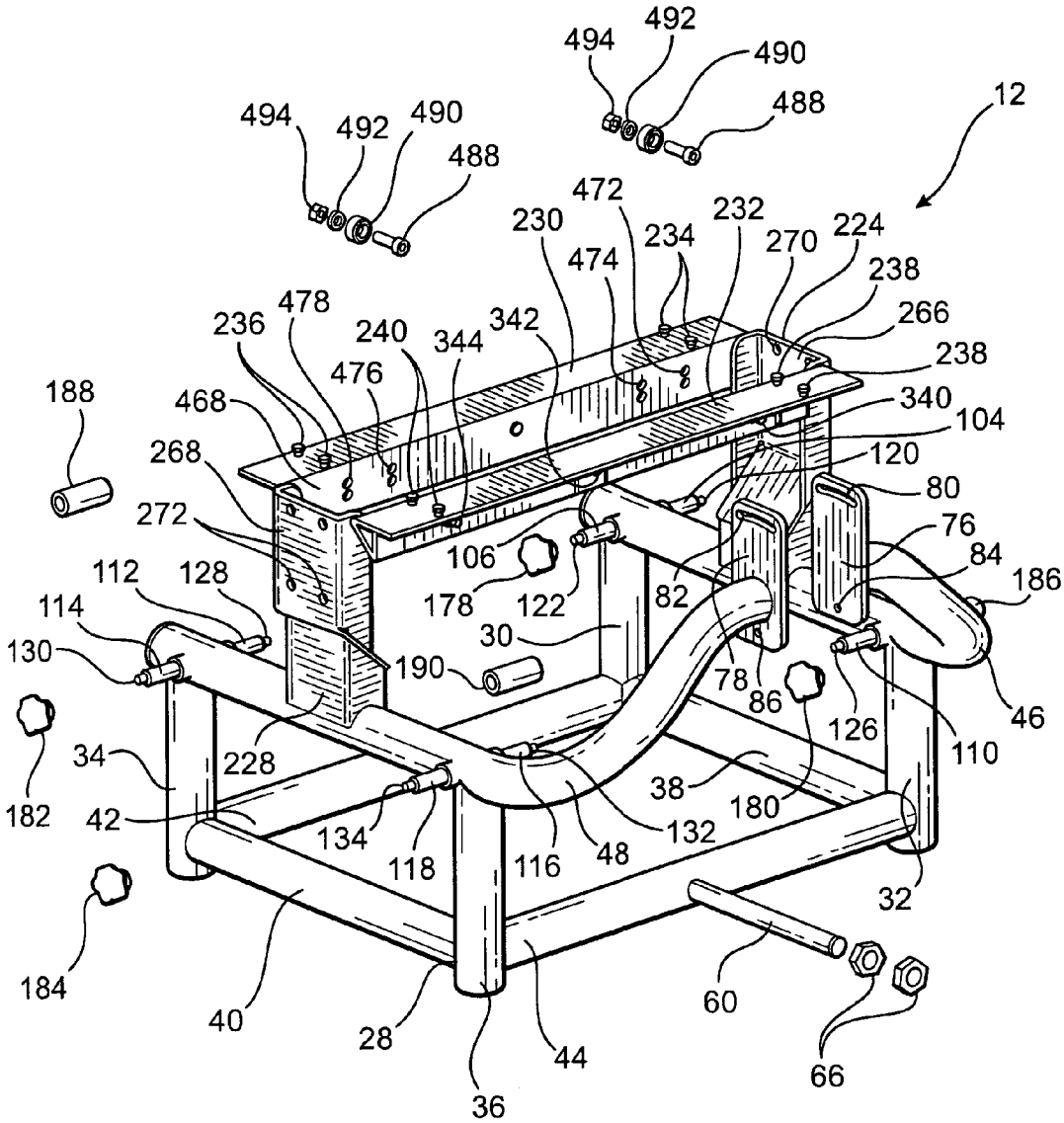
FIG. 4 is an enlarged and exploded rear perspective detailed view of the frame tube subassembly of the new and improved case sealer assembly as disclosed within FIG. 2.

More particularly, as can readily be appreciated from FIGS. 3 and 4, the frame tube subassembly 12 is seen to comprise a base frame structure 28 which comprises four upstanding corner posts or legs 30,32,34,36, a pair of lower, oppositely disposed end frame members 38,40 which respectively interconnect together the lower end portions of the upstanding corner posts or legs 30,32 and 34,36, and a pair of lower, oppositely disposed side frame members 42,44 which respectively interconnect together the lower end portions of the upstanding corner posts or legs 30,34 and 32,36. Still further, a pair of upper, oppositely disposed end frame members 46,48 are respectively fixedly mounted upon the upper end portions of the upstanding corner posts or legs 30,32 and 34,36 so as to not only effectively interconnect together the upper end portions of the upstanding corner posts or legs 30,32 and 34,36, but, in addition, as will become more fully apparent hereinafter, the pair of upper, oppositely disposed end frame members 46,48 serve to support the side rail subassembly 16, the belt drive subassembly 18, the motor starter subassembly 20, and the mast subassembly 26. It is noted that all of the frame members of the frame tube subassembly 12, that is, the upstanding corner posts or legs 30-36, the lower end frame members 38,40, the lower side frame members 42,44, and the upper end frame members 46,48 are all fabricated from round tubular or rod stock such that when, for example, a wash-down process or procedure is performed upon the case sealer assembly or apparatus 10, water will tend to readily drain from the frame members 30-48 and not tend to accumulate upon the frame members 30-48 of the frame tube subassembly 12 whereby the same can be thoroughly cleaned and dried so as to effectively minimize or eliminate the potential for such regions or areas of the case sealer assembly or apparatus 10 to harbor bacteria or to foster the growth thereof. In addition, as may be surmised, each one of the upstanding corner posts or legs 30-36 of the frame tube subassembly 12 is provided with means for adjustably leveling the frame tube subassembly 12 in order to properly stabilize the entire case sealer apparatus or assembly 10 upon a suitable floor or support platform or surface.

More particularly, as can best be seen from FIG. 3, each one of the upstanding corner posts or legs 30-36 of the frame tube subassembly 12 has an internally threaded nut, not shown, fixedly disposed within the lower end portion thereof, and an annular plastic cap 50 is adapted to be fixedly mounted upon the lower surface portion of each one of the upstanding corner posts or legs 30-36, by means of suitable fasteners 52, so as to effectively close off or seal the interior of each one of the corner posts or legs 30-36. In addition, as can best be seen as a result of additional reference being made to FIGS. 1 and 5, the means for adjustably leveling the frame tube subassembly 12 further comprises the plurality of leveler mechanisms 14 wherein each one of the leveler mechanisms 14 comprises a foot member 54. Each foot member 54 is respectively provided with a vertically upstanding, externally threaded rod member 56, and a hex nut 58 is effectively fixedly mounted upon the lower end portion of the externally threaded upstanding rod member 56. Accordingly, the upper end portion of each one of the threaded rod members 56 is adapted to be threadedly engaged with the internally threaded nut member, not shown, that is fixedly mounted within the lower end portion of each one of the upstanding corner posts or legs 30-36, and as a result of rotating the individual leveler mechanisms 14, by means of a suitable wrench-type tool or the like which is adapted to be operatively engaged with the hex nut 58 fixedly mounted upon the lower end portion of each one of the vertically upstanding threaded rods 56, the relative disposition of each one of the foot members 54 with respect to one of the upstanding corner posts or legs 30-36 can be readily adjusted so as to achieve a leveling operation or procedure within or at a particular corner region of the case sealer apparatus or assembly 10.

Continuing further, while it is appreciated from FIGS. 1 that each one of the four upstanding corner posts or legs 30-36 is respectively provided with one of the leveler mechanisms 14 so as to achieve a leveling operation or procedure within or at a particular corner region of the case sealer apparatus or assembly 10, it can also be appreciated from FIGS. 2 and 5 that, in accordance with the principles and teachings of the present invention, a total of five leveler mechanisms 14 are provided wherein the fifth leveler mechanism 14 is adapted to be used in conjunction with the mast subassembly 26. More particularly, as can be further appreciated from FIGS. 4 and 11, it is seen that an externally threaded rod member 60 projects rearwardly from the lower side frame member 44 of the tube frame subassembly 12, and that a vertically upstanding mast member 62 has a throughbore 64 defined within the lower end portion thereof. The lower end portion of the vertically upstanding mast member 62 is adapted to be mounted upon the externally threaded rod member 60, and in order to properly locate and secure the lower end portion of the vertically upstanding mast member 62 at a predetermined position upon the externally threaded rod member 60, as will be explained more fully hereinafter, a pair of nut members 66, as seen in FIG. 4, and a pair of sealing washers 68, as seen in FIG. 11, are provided.

A first one of the nut members 64 will therefore be threadedly engaged upon the externally threaded rod member 60 so as to be located at the predetermined position at which the lower end portion of the vertically upstanding mast member 62 is to be located upon the externally threaded rod member 60, and a first one of the pair of washers 68 will then be inserted onto the threaded rod member 60 so as to abut against the first one of the nut members 64 that was previously threadedly engaged upon the externally threaded rod member 60. The vertically upstanding mast member 62 will then be mounted upon the externally threaded rod member 60 by effectively inserting the externally threaded rod member 60 through the throughbore 64 defined within the lower end portion of the vertically upstanding mast member 62 until the inner or forward facing lower surface portion of the vertically upstanding mast member 62 abuts or is disposed in contact with the first washer 68 disposed upon the externally threaded rod member 60. Subsequently, the second one of the pair of washers 68 will be inserted onto the externally threaded rod member 60, and lastly, the second nut member 66 will be threadedly engaged upon the externally threaded rod member 60 until the second nut member 66 causes the second washer 68 to abut the outer or rearwardly facing lower surface portion of the vertically upstanding mast member 62, thereby fixedly positioning the lower end portion of the vertically upstanding mast member 62 upon the externally threaded rod member 60.

It is noted still further, as can best be seen from FIG. 11, that the vertically upstanding mast member 62 is adapted to have a cap or plate 70, similar to any one of the caps 50 provided in connection with the plurality of upstanding corner posts or legs 30-36, fixedly mounted upon the lower surface portion thereof by means of suitable fasteners 72 so as to effectively close off or seal the interior of the vertically upstanding mast member 62. In addition, it is seen that the cap or plate 70 is provided with a throughbore 74 through which the externally threaded vertically upstanding rod member 56 of the fifth leveler mechanism 14 is adapted to be inserted. As was the case with the other four leveler mechanisms 14 respectively mounted within the four upstanding corner posts or legs 30-36, the upstanding rod member 56 of the fifth leveler mechanism 14 is adapted to be threadedly engaged with a nut member, not shown, housed within the lower end portion of the vertically upstanding mast member 62. It is lastly noted that in order to effectively complete the mounting of the vertically upstanding mast member 62 upon the tube frame subassembly 12, the rearwardly disposed free end portions of the upper end frame members 46,48 of the tube frame subassembly 12 are respectively provided with mounting plates 76,78, and the mounting plates 76,78 are respectively provided with upper, arcuately shaped slots 80,82 and lower apertures 84,86.

Correspondingly, as can best be seen from FIG. 11, oppositely disposed end surface portions of the vertically upstanding mast member 62 are provided with an upper pair of outwardly projecting pins or lugs 88, only one set of which is actually visible, which are adapted to be respectively disposed within the upper arcuately shaped slots 80,82 of the mounting plates 76,78, and a lower outwardly projecting pin or lug 90, only one of which is actually visible, which is adapted to be respectively disposed within the lower apertures 84,86 of the mounting plates 76,78. It is important that, as will be more fully explained later when the description discusses the head subassembly 24 which is adapted to be mounted upon the vertically upstanding mast member 62, the vertically upstanding mast member 62 is disposed at a particular substantially vertical orientation such that the head subassembly 24, in turn, has an orientation which permits the tape cartridge mounted thereon to be disposed substantially parallel to the conveyor drive belts of the conveyor drive belt subassembly 18. Accordingly, in order to properly adjust and achieve the particular substantially vertical orientation of the vertically upstanding mast member 62 in order to, in turn, provide the head subassembly 24 with its proper orientation, the vertically upstanding mast member 62 can effectively be pivoted around the pivotal axis defined by means of the pins 90 disposed upon the opposite surfaces of the mast member 62 and disposed within the apertures 84,86 of the mounting plates 76,78. In addition, the pins 88 of the mast member 62 will be guided within the arcuately shaped slots 80,82 of the mounting plates 76,78, and when the particular vertical orientation of the mast member 62 is achieved, the locknuts 66,66 are tightened into engagement with the opposite lower side surfaces of the mast member 62. It is lastly noted that in order to permit such pivotal adjustment of the mast member 62 around the pivotal axis defined by means of the pins 90, the outer diametrical extent of the externally threaded rod member 60, disposed upon the tube frame subassembly 12, is substantially smaller than the inner diametriccal extent of the throughbore 64 defined within the lower end portion of the mast member 62 so as to permit sufficient play therebetween. In addition, the sealing washers 68 effectively close off or seal the opposite ends of the throughbore 64 so as to prevent the ingress or entrance of water into the throughbore 64.

Reverting back to FIGS. 1, 3, and 4, and with additional reference being made to FIG. 6, the means for mounting the side rail subassembly 16 upon the tube frame subassembly 12 will now be described. As can best be appreciated from FIG. 6, it is seen that the side rail subassembly 16 comprises a pair of oppositely disposed side rail members 92,94, and it is further seen that the side rail member 92 has a pair of mounting arms 96,98 fixedly mounted thereon and projecting downwardly therefrom, while the side rail member 94 similarly has a pair of mounting arms 100,102 fixedly mounted thereon and projecting downwardly therefrom. In addition, as can best be seen from FIGS. 1, 3, and 4, the upper end frame member 46 is provided with two pairs of oppositely disposed pintles or trunnions 104,106, and 108,110, respectively disposed within the vicinities of the upper end portions of the upstanding corner posts or legs 30,32, and in a similar manner, the upper end frame member 48 is provided with two pairs of oppositely disposed pintles or trunnions 112,114, and 116,118, respectively disposed within the vicinities of the upper end portions of the upstanding corner posts or legs 34,36. In addition, a plurality of externally threaded stub shafts 120-134 are respectively provided upon the plurality of pintles or trunnions 104-118.

Correspondingly, it is seen that free or distal end portions of the downwardly projecting arms 96,98 of the side rail member 92 are respectively provided with collar members 136,138, and that each one of the collar members 136,138 has a pair of bushing members 140,142, and 144,146, which are adapted to be inserted into the opposite ends of the collar members 136,138 so as to enable the collar members 136,138 to be respectively pivotally mounted upon, for example, the pintles or trunnions 106,114, as can best be appreciated from FIG. 1, when the case sealer apparatus or assembly 10 is set up or erected for conveying cases or cartons in the direction extending from the right end of FIG. 1 toward the left end of FIG. 1. In a similar manner, the free or distal end portions of the downwardly projecting arms 100,102 of the side rail member 94 are respectively provided with collar members 148,150, and the collar members 148,150 respectively have a pair of bushing members 152,154, and 156,158, which are adapted to be inserted into the opposite ends of the collar members 148,150 so as to enable the collar members 148, 150 to be respectively pivotally mounted upon, for example, the pintles or trunnions 110,118, as can best be appreciated from FIG. 1, when the case sealer apparatus or assembly 10 is set up or erected for conveying cases or cartons in the direction extending from the right end of FIG. 1 toward the left end of FIG. 1. When the pair of side rail members 92, 94 are mounted upon the tube frame subassembly 12 in accordance with the foregoing, it is desired to operatively connect the pair of side rail members 92,94 together so as to facilitate the simultaneous adjustable positioning of the pair of side rail members 92,94 whereby the pair of side rail members 92,94 can together effectively accommodate and guide differently sized cases or cartons to be sealed by means of the case sealer assembly or apparatus 10.

Figure 6:
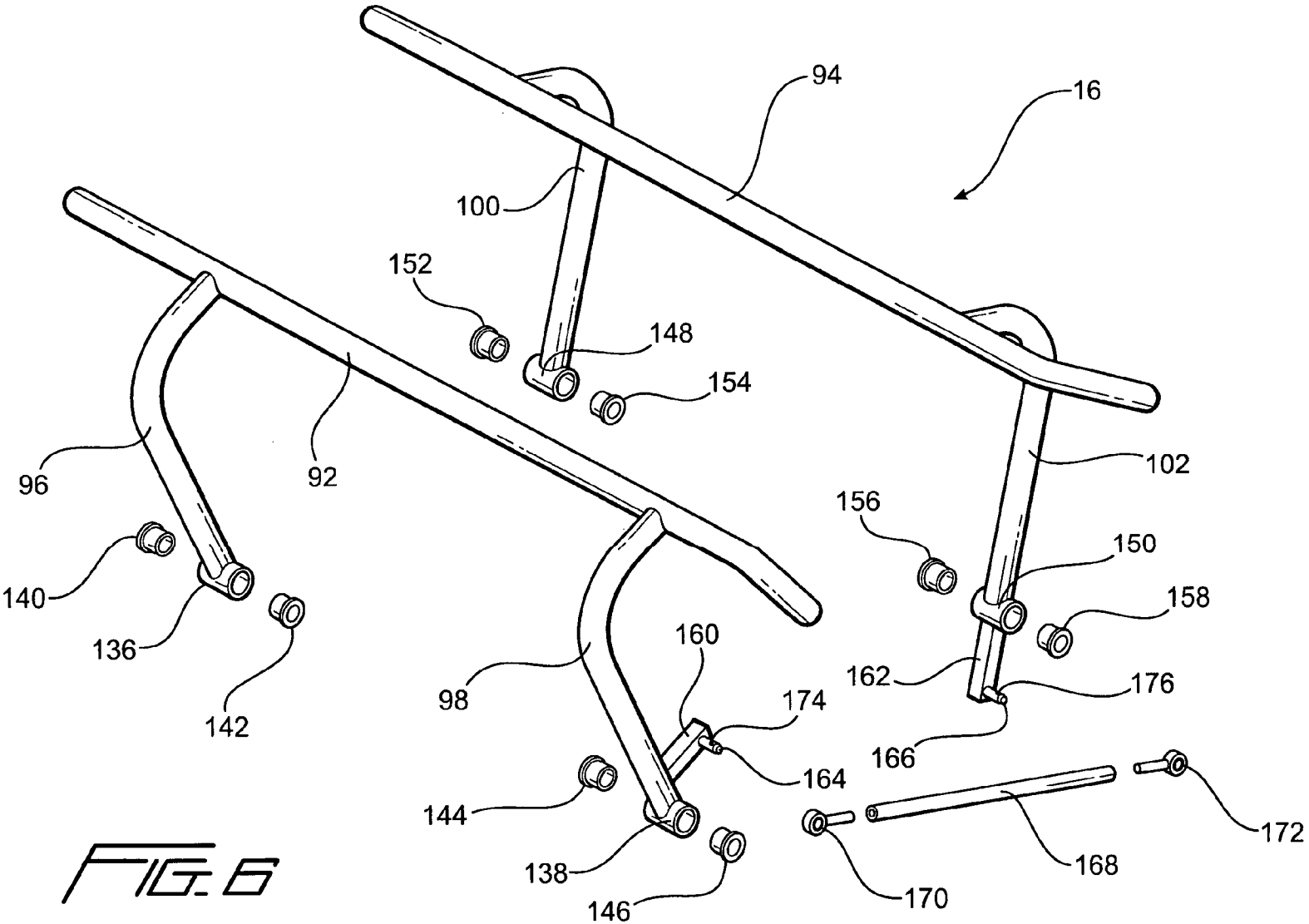
FIG. 6 is an enlarged and exploded perspective detailed view of the side rail subassembly of the new and improved case sealer assembly as disclosed within FIG. 2.

Accordingly, as can further be appreciated from FIGS. 1 and 6, the downwardly projecting arms 98,102 of the side rail members 92,94 are respectively provided with arm extensions 160,162 which are mounted upon the downwardly projecting arms 98,102 within the vicinities of the collar members 138,150, and the arm extensions 160,162 have stub shafts 164,166 respectively mounted upon the free or distal end portions thereof. A linkage bar or rod 168 is adapted to operatively interconnect the lower end portions of the downwardly projecting arms 98,102, and accordingly, bearing members 170, 172 are adapted to have their rod portions inserted into the oppositely disposed end portions of the linkage bar or rod 168. The stub shafts 164,166, integrally mounted upon the arm extensions 160,162, are also respectively provided with spring-biased detent buttons 174,176, and accordingly, when the bearing members 170,172 are being mounted upon the stub shafts 164,166, the bearing members 170,172 will encounter the detent buttons 174,176, effectively depress the detent buttons 174,176 downwardly into the stub shafts 164,166, and after passing beyond the detent buttons 174,176, the detent buttons 174,176 will resume their original positions under the influence of their biasing springs so as to effectively retain the bearing members 170,172 upon the stub shafts 164, 166. As a result of the interconnection of the lower end portions of the downwardly projecting arms 98,102 of the side rail members 92,94 by means of the linkage bar or rod 168, it can be appreciated from FIG. 1 that when, for example, a first one of the side rail members 92,94 is pivotally moved upon its pintles or trunnions 106,114 or 110,118 in a particular direction, that is, either toward or away from the central conveying axis of the case sealer assembly or apparatus 10, the other one of the side rail members 92,94 will be pivotally moved upon its pintles or trunnions 106,114 or 110,118 in a corresponding direction so that the pair of side rail members 92,94 are always simultaneously pivotally adjusted either toward or away from each other.

In order to secure each one of the collar members 136,138, 148,150, along with their respective bushing members 140, 142,144,146,152,154,156,158, onto their respective pintles or trunnions 106,114,110,118, the externally threaded stub shafts 122,126,130,134, integrally mounted upon the pintles or trunnions 106,114,110,118, are respectively adapted to have internally threaded, manually operated knob-type fasteners 178,180,182,184, which are best illustrated within FIGS. 1, 3, and 4, threadedly connected thereto. It can therefore be appreciated that once the pair of side rail members 92,94 are positionally adjusted upon the case sealer assembly or apparatus 10, the disposition of the side rail members 92,94 can be fixed with respect to the tube frame subassembly 12 as a result of tightening the manually operated knob-type fasteners 178-184.

It is noted that since the pintles or trunnions 104,108,112, 116 are not being used in connection with the mounting of the side rail subassembly 16 upon the tube frame subassembly 12, as can best be appreciated from FIGS. 1, 3, and 4, a plurality of rubber protective caps 186,188,190 are respectively mounted upon the pintles or trunnions 108,112, 116 in order to protect the plurality of externally threaded stub shafts 124,128,132 of the pintles or trunnions 108,112, 116 as well as to effectively seal such structures from water during wash-down cleaning operations. It is noted that a protective cap is not in fact mounted upon the pintle or trunnion 104 in order to protect the externally threaded stub shaft 120 thereof because, as will become more apparent hereinafter, the motor starter subassembly 20 will be mounted upon the externally threaded stub shaft 120. Still further, it is lastly noted that the side rail subassembly 16 may be mounted upon the tube frame subassembly 12 in a reversed manner so as to accommodate reversed manufacturing flow-through processes or procedures. Such a reversed mounting may simply be achieved by removing the collar members 136,138,148,150 of the downwardly projecting arms 96-102 from their pintles or trunnions 106,110,114,118 and mounting the collar members 136,138, 148,150 of the downwardly projecting arms 96-102 upon the pintles or trunnions 104,108,112,116. When the foregoing structures are mounted in this reversed mode, the motor starter subassembly 20 will be threadedly engaged with the externally threaded stub shaft 134, while the rubber protective caps 186,188,190 will be respectively mounted upon the pintles or trunnions 106,110,114.

Figure 7:
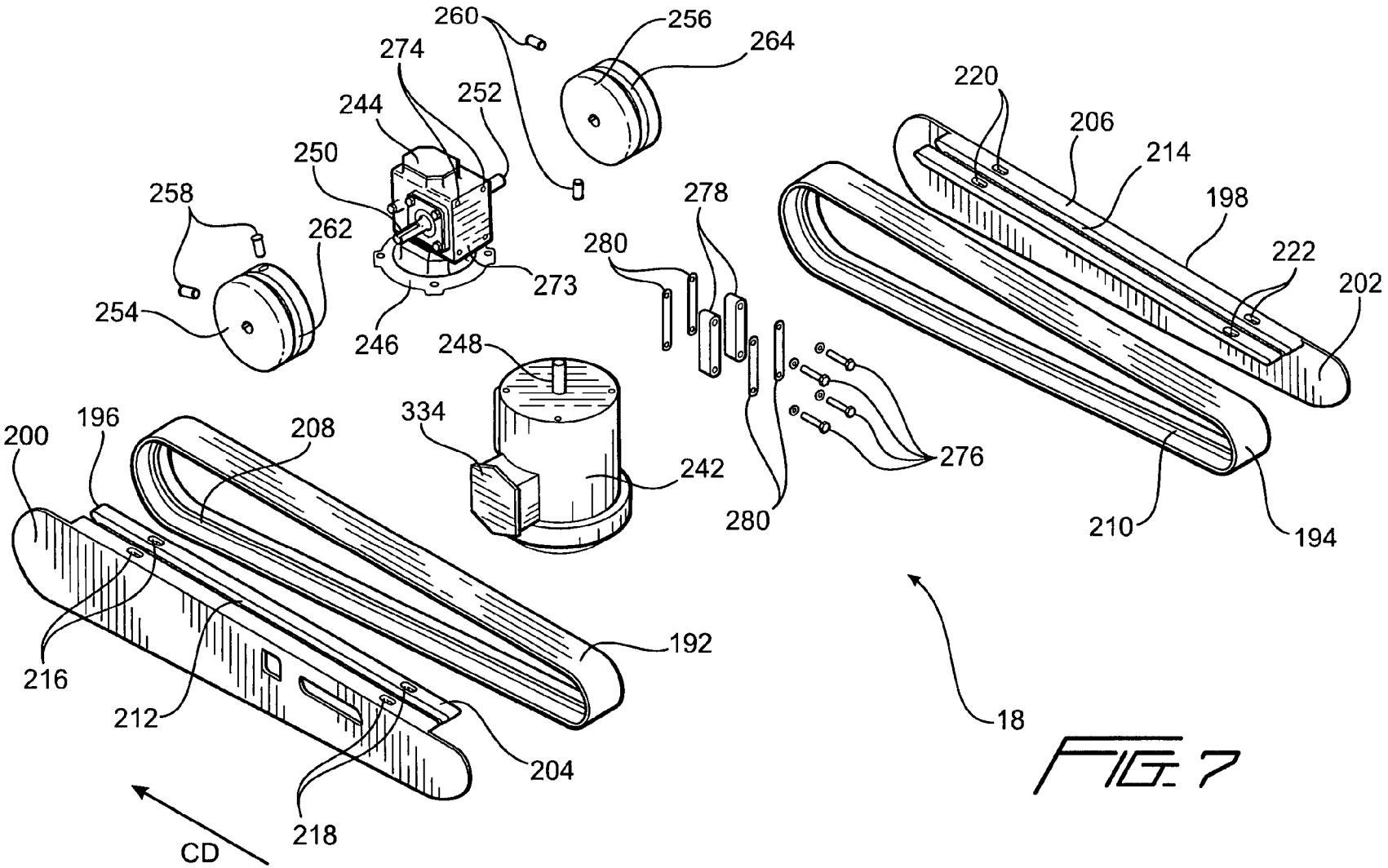
FIG. 7 is an enlarged and exploded perspective detailed view of the belt drive subassembly of the new and improved case sealer assembly as disclosed within FIG. 2.

With reference now being made to FIG. 7, in conjunction with FIGS. 1, 3, and 4, the conveyor belt drive subassembly 18 of the new and improved case sealer assembly or apparatus 10 will now be described. More particularly, as can best be appreciated from FIG. 7, the conveyor belt drive subassembly 18 is seen to comprise a pair of transversely spaced, endless loop-type conveyor belts 192,194 and a pair of transversely spaced conveyor belt guides 196,198. It is seen that the conveyor belt guides 196,198 respectively have substantially L-shaped cross-sectional configurations comprising vertically oriented external side wall members 200,202, and horizontally oriented upper guide members 204, 206 upon which the upper runs of the conveyor belts 192,194 are adapted to be supported and guided. It will be noted that the interior peripheral surfaces of the conveyor belts 192, 194 are respectively provided with radially inwardly projecting profiles or ridge members 208,210, and correspondingly, the upper guide members 204,206 of the conveyor belt guides 196,198 are respectively provided with longitudinally extending slots 212,214 within which the profiles or ridge members 208,210 of the conveyor belts 192,194 are adapted to be disposed whereby the conveyor belts 192,194 will accordingly be guided during their continuous rotary drive or conveyance operations. Still further, it is seen that each one of the horizontally oriented upper guide members 204,206 of the conveyor belt guides 196,198 is provided with two pairs of longitudinally spaced key-hole shaped apertures 216,218 and 220, 222 whereby the pair of conveyor belt guides 196,198 can be removably mounted atop a lower case sealer tape cartridge housing 224 which has oppositely disposed, lower end wall members 226,228 integrally fixed upon the upper end frame members 46,48 of the tube frame subassembly 12.

More particularly, as can best be seen from FIGS. 3 and 4, it is seen that the lower case sealer tape cartridge housing 224 also comprises a pair of upper, transversely spaced, horizontally oriented mounting plates 230,232 upon which the horizontally oriented upper guide members 204,206 of the conveyor belt guides 196,198 are adapted to be affixed and supported, and along these lines, it is seen that each one of the horizontally oriented mounting plates 230,232 is provided with two pairs of longitudinally spaced upstanding lugs 234, 236 and 238,240. The pairs of longitudinally spaced upstanding lugs 234,236 and 238,240 are adapted to be respectively inserted within the pairs of longitudinally spaced key-hole shaped apertures 216,218 and 220,222 defined within the guide members 204,206 of the conveyor belt guides 196, 198, and when the conveyor belt guides 196,198 are moved longitudinally in the downstream or conveyance direction, as indicated by means of the arrow CD within FIG. 7, the conveyor belt guides 196,198 will effectively be locked in position atop the mounting plates 230,232 of the lower case sealer tape cartridge housing 224. It is lastly noted in connection with the fixation of the conveyor belt guides 196,198 upon the mounting plates 230,232 of the lower case sealer tape cartridge housing 224, that since the conveyor belts 192,194 are driven in the aforenoted conveyance direction CD, the constant contact and friction generated between the interior or undersurface portions of the upper runs of the conveyor belts 192,194 and the upper surface portions of the guide members 204,206 will tend to always force the conveyor belt guides 196,198 in the downstream or conveyance direction CD with respect to the underlying mounting plates 230,232 of the lower case sealer tape cartridge housing 224 whereby the conveyor belt guides 196,198 will always be fixedly locked in position upon the underlying mounting plates 230,232 of the lower case sealer tape cartridge housing 224.

In connection with the actual drive means for the conveyor belts 192,194, and with reference continuing to be made to FIG. 7, the conveyor belt drive subassembly 18 further comprises a drive motor 242 and a gear box 244 which is adapted to have the drive motor 242 affixed to a bottom flange portion 246 of the gear box 244 by means of suitable fasteners, not shown. The drive motor 242 is provided with an upstanding drive output shaft 248, and the gear box 244 has a pair of output drive shafts 250,252 rotatably mounted upon oppositely disposed side surface portions thereof. In addition, a pair of drive rollers 254,256 are adapted to be respectively disposed upon the output drive shafts 250,252 of the gear box 244, and in order to fixedly secure the pair of drive rollers 254,256 upon the drive shafts 250,252, pairs of set screws 258,260 are respectively radially inserted within predetermined sections of each one of the drive rollers 254, 256 so as to engage the output drive shafts 250,252 of the gear box 244. It is also seen that the outer peripheral or circumferential surface portions of the drive rollers 254,256 are respectively provided with annular slots 262,264, and in this manner, the radially inwardly projecting profiles or ridge members 208, 210 of the conveyor belts 192,194 can be accommodated whereby the conveyor belts 192,194 can be maintained at their predetermined positions upon, and engaged with, the drive rollers 254,256.

Still further, as can best be seen from FIGS. 1, 3, and 4, in addition to the lower case sealer tape cartridge housing 224 comprising the oppositely disposed, lower end wall members 226,228, the lower case sealer tape cartridge housing 224 also comprises a pair of oppositely disposed, upper end wall members 266,268, and as can be seen within FIG. 1, the gear box 244 is adapted to be fixedly mounted upon the upper end wall member 266 of the lower case sealer tape cartridge housing 224. More particularly, the upper end wall members 266,268 of the lower case sealer tape cartridge housing 224 are respectively provided with a plurality of apertures 270,272, and as can best be seen from FIG. 7, an external side wall member 273 of the gear box 244 is likewise provided with a plurality of apertures 274. In addition, a plurality of fasteners 276 are adapted to be passed through the apertures 270 of the upper end wall member 266 of the lower tape cartridge housing 224 and the apertures 274 of the end wall member 273 of the gear box 244, however, it is also seen that a plurality of spacers 278, and a plurality of insulation seals 280, are adapted to be interposed between the exterior surface portion of the upper end wall member 266 of the lower tape cartridge housing 224 and the external side wall member 273 of the gear box 244 so as to in fact space the external side wall member 273 of the gear box 244 from the exterior surface portion of the upper end wall member 266 of the lower tape cartridge housing 224 in order to effectively prevent the creation of a region within which water, and potential bacteria, could accumulate. It is lastly noted in connection with the conveyor belt drive subassembly 18 that, as was the case with the side rail subassembly 16, the entire conveyor belt drive subassembly 18 could be mounted upon the lower tape cartridge housing 224 in a reversed manner whereby, in lieu of the conveyor drive belts 192,194 being movable in the conveyor direction CD as noted within FIG. 1, that is, from right to left as viewed within FIG. 1, the conveyor drive belts 192,194 would be movable in the opposite direction, that is, from left to right as viewed within FIG. 1. In such a case, it is also to be noted that the gear box 244, in lieu of being fixedly mounted upon the upper end wall member 266, would be fixedly mounted upon the oppositely disposed upper end wall member 268.

Figure 8:
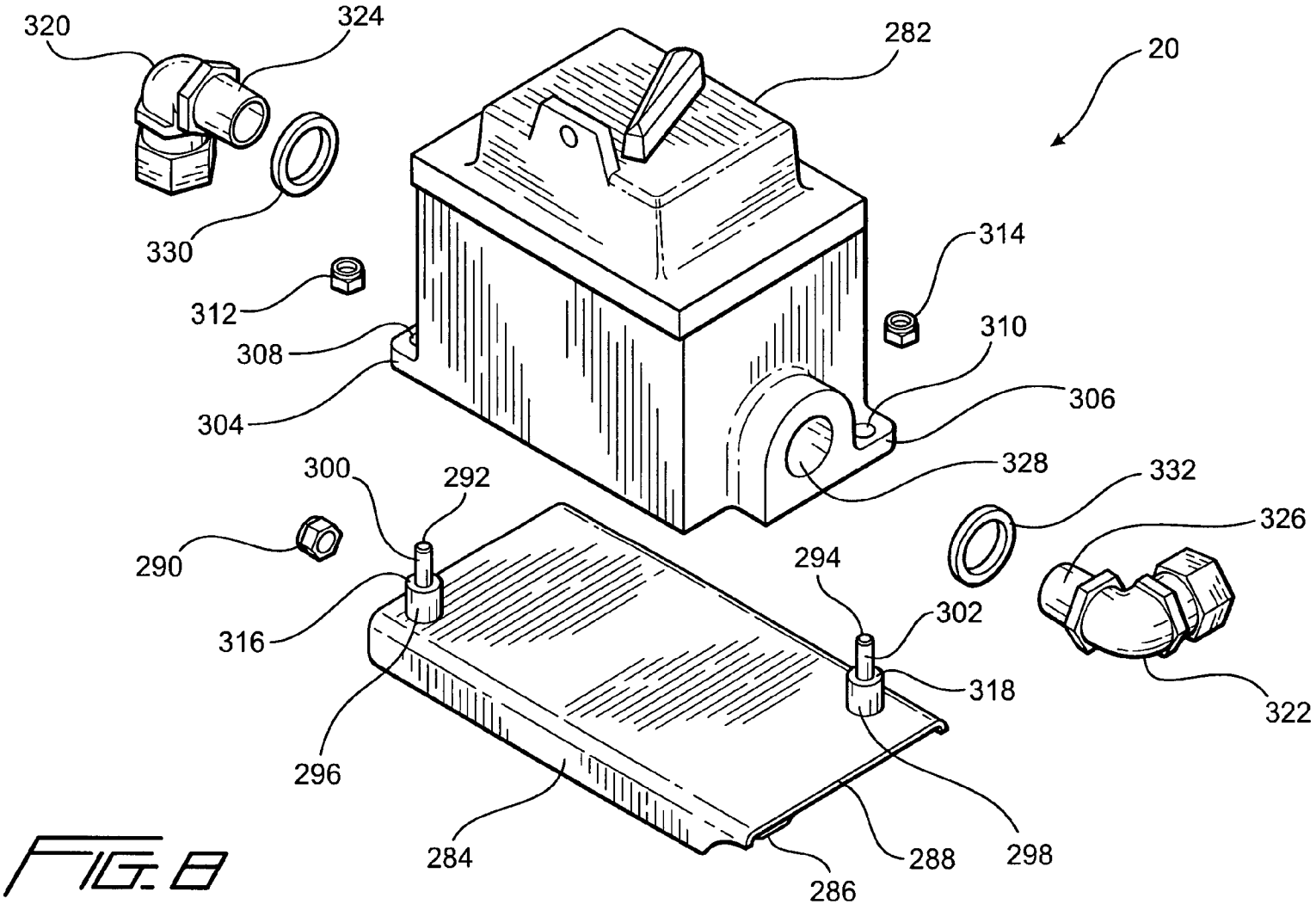
FIG. 8 is an enlarged and exploded perspective detailed view of the motor starter subassembly of the new and improved case sealer assembly as disclosed within FIG. 2.

Continuing further, in order to provide and control electrical power to the conveyor belt drive motor 242, a motor starter subassembly 20 is incorporated within the case sealer assembly or apparatus 10 as can best be seen within FIGS. 1, 2, and 8. With particular reference being made to FIG. 8, the motor starter subassembly 20 is seen to comprise a motor starter housing 282, which essentially comprises a water-tight container, and a mounting or support plate 284 by means of which the motor starter subassembly 20 is adapted to be mounted upon the tube frame subassembly 12. In particular, as has been previously noted, the motor starter subassembly 20 is adapted to be mounted upon pintle or trunnion 104 of the tube frame subassembly 12, and accordingly, the mounting or support plate 284 has a mounting block or tab 286 fixedly mounted upon an undersurface portion thereof for mating with the pintle or trunnion 104, it being noted that only a small portion of the mounting block or tab 286 is visible within FIG. 8. In addition, an end edge portion 288 of the mounting or support plate 284 is adapted to be seated upon or disposed in contact with the upper end frame member 46 of the tube frame subassembly 12, as can best be appreciated from FIG. 1, and a lock nut 290 is adapted to be threadedly engaged with the externally threaded stub shaft 120 operatively associated with the pintle or trunnion 104 so as to in fact fixedly secure the mounting or support plate 284, and the motor starter subassembly 20 upon the tube frame subassembly 12.

It is further seen that a pair of upstanding studs or stand-offs 292,294 are fixedly mounted upon the upper surface portion of the mounting or support plate 284, and are disposed within diagonally opposite corner regions thereof, and that the pair of upstanding studs or stand-offs 292,294 comprise stepped structures which respectively comprise relatively large diameter lower portions 296,298, and relatively small diameter upper, externally threaded stub shaft portions 300, 302. The motor starter housing 282 is provided with a pair of flanged portions 304,306 within the diagonally opposite lower corner regions thereof, and it is seen that the flanged portions 304,306 are respectively provided with a through-bore 308,310. Accordingly, when the motor starter housing 282 is adapted to be mounted upon the upstanding studs or stand-offs 292,294, the upper externally threaded stub shaft portions 300,302 thereof will be inserted through the through-bores 308,310 defined within the lower flanged corner portions 304,306 of the motor starter housing 282, and lock nuts 312,314 will be respectively threaded onto the upper externally threaded stub shaft portions 300,302. It will be noted that the starter motor housing 282 will actually be seated upon annular shoulder portions 316,318 of the upstanding studs or stand-offs 292,294, and in this manner, the undersurface portion of the starter motor housing 282 will be spaced from the upper surface portion of the mounting or support plate 284.

Accordingly, when the case sealer assembly or apparatus 10 is subjected to a wash-down operation or procedure, water will not readily accumulate within cracks, crevices, or spaces defined between adjoining components of the case sealer assembly or apparatus 10. It is lastly noted that the motor starter subassembly 20 essentially comprises overload protection means for the conveyor belt drive motor 242, and therefore, the motor starter subassembly 20 has various overload or circuit breaker type mechanisms disposed internally thereof. In order to provide electrical connection between a power source, not shown, and the conveyor belt drive motor 242, oppositely disposed end portions of the starter motor housing 282 are adapted to have suitable power cable conduits or connectors 320,322 connected thereto. More particularly, the conduits or connectors 320,322 are respectively provided with externally threaded end portions 324,326 which are adapted to be mated with internally threaded sockets, only one of which is visible within FIG. 8 at 328, defined within the opposite end portions of the starter motor housing 282, and a pair of sealing washers 330,332 are adapted to be interposed between the externally threaded end portions of the conduits or connectors 320,322 and the internally threaded end portions 328 of the motor starter housing 282 so as to seal the connections defined between the externally threaded end portions of the conduits or connectors 320,322 and the internally threaded end portions 328 of the motor starter housing 282. It is also noted that the conduit or connector 320 is adapted to be electrically connected to the power source, not shown, while the conduit or connector 322 is adapted to be electrically connected to a junction box 334 mounted upon a side wall portion of the conveyor belt drive motor 242.

Continuing further, and with reference being specifically made to FIG. 9, in conjunction with FIGS. 1 and 7, one of the pair of tension roller bracket subassemblies 22, which are respectively utilized in conjunction with the pair of conveyor drive belts 192,194 so as to adjustably tension the same to a predetermined tension level, will now be described, it being appreciated that the pair of tension roller bracket subassemblies 22 are substantially identical to each other, although, in fact, that they are actually mirror images of each other. More particularly, it is seen that each one of the tension roller bracket subassemblies 22 comprises a mounting plate 336 which is provided with a pair of apertures 338, only one of which is visible, within substantially opposite ends thereof. In addition, as can best be seen from FIG. 4, each side of the lower tape cartridge housing 224, disposed beneath the horizontally oriented mounting plates 230,232, is provided with three longitudinally spaced externally threaded stub shafts 340,342,344 wherein it is to be appreciated that when each one of the mounting plates 336 of the tension roller bracket subassemblies 22,22 is to be mounted upon a respective one of the side portions of the lower tape cartridge housing 224, one of the end stub shafts 340,344 and the centrally located stub shaft 342 will be inserted within the pair of apertures 338 of each mounting plate 336, and subsequently, the mounting plate 336 is then fixedly secured upon the lower tape cartridge housing 224 by means of a pair of lock nuts 346,348 which are threadedly secured upon the selected one of the end stub shafts 340,344 and the central stub shaft 342. It is to be noted that, as was the case with, for example, the previously described side rail subassembly 16, the conveyor belt drive subassembly 18, and the motor starter subassembly 20, the pair of tension roller bracket subassemblies 22,22 are adapted to be mounted upon the lower tape cartridge housing 224 in reversed modes whereby, for example, the mounting plates 336 will be fixedly mounted upon the other ones of the end stub shafts 340,344 as well as the central stub shafts 342.

Figure 9:
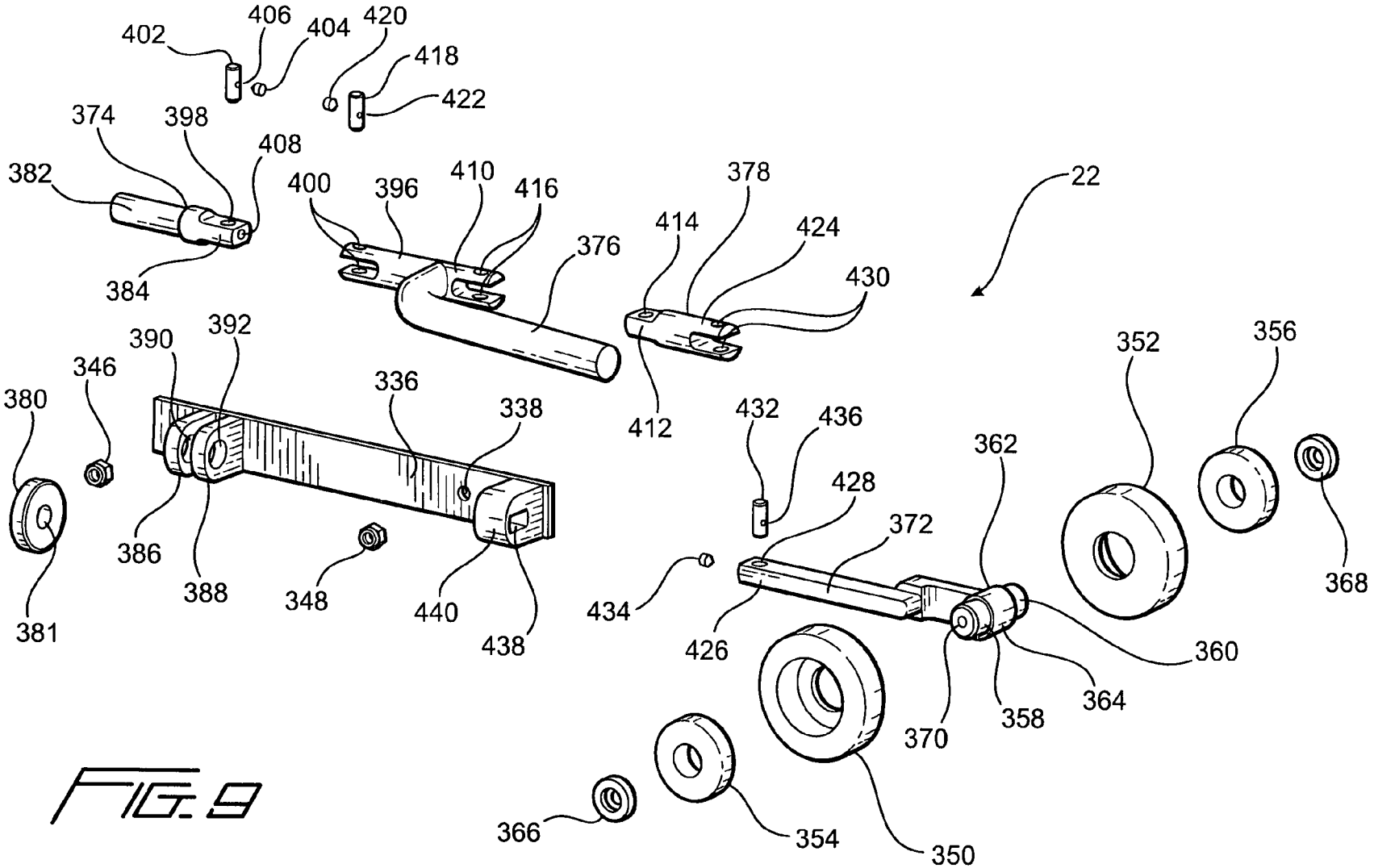
FIG. 9 is an enlarged and exploded perspective detailed view of one of the tension roller bracket subassemblies of the new and improved case sealer assembly as disclosed within FIG. 2.

With reference still being made to FIG. 9, each one of the tension roller bracket subassemblies 22,22 also comprises a pair of idler rollers 350,352 which are effectively or operatively mounted upon each one of the mounting plates 336, and which are respectively adapted to be adjustably tensioned against the interior surface portions of each one of the conveyor belts 192,194 so as to in fact provide the conveyor belts 192,194 with a predetermined degree of tension. More particularly, the pair of idler rollers 350,352 have bearing members 354,356 respectively disposed internally thereof, and the pair of idler rollers 350,352, through means of their bearing members 354,356, are adapted to be rotatably mounted upon opposite, relatively small diameter end portions 358,360 of an idler roller support shaft 362 such that the relatively large diameter central portion 364 of the idler roller support shaft 362 is interposed between the pair of idler rollers 350,352. In this manner, the pair of idler rollers 350,352 will be axially separated from each other so as to define a space therebetween which can accommodate and contain one of the radially inwardly projecting profiles or ridge members 208,210 of one of the conveyor belts 192,194. Washers 366,368 are disposed externally of the bearing members 354,356, and bolt fasteners, not shown, are adapted to be threadedly engaged within axially oriented apertures 370, only one of which is visible, which are provided within the opposite ends of the idler roller support shaft 362 so as to fixedly secure the idler rollers 350,352, the bearing members 354,356, and the washers 366,368 upon the idler roller support shaft 362.

The idler roller support shaft 362 is fixedly mounted upon an end portion of a linear linkage bar 372, and the means for acting upon the idler rollers 350,352, through means of the idler roller support shaft 362 and the linear linkage bar 372 so as to adjust the tension within the conveyor belts 192,194, comprises an adjustment link 374, a manually operable handle 376, a force transmission link 378, and a rotary adjustment wheel 380 having an internally threaded bore 381. The adjustment link 374 is seen to comprise an externally threaded rod portion 382 and a connection rod portion 384. The mounting plate 336 has a pair of ears 386,388 fixedly mounted thereon wherein each one of the ears 386,388 has a throughbore 390,392 defined therein. The threaded rod portion 382 of the adjustment link 374 is adapted to be passed through the throughbores 390,392 of the ears 386,388, and the adjustment wheel 380 is adapted to be interposed between the ears 386,388 such that the internally threaded bore 381 of the adjustment wheel 380 can be threadedly mated with the threaded rod portion 382 of the adjustment link 374. In addition, as can best be seen from FIGS. 1 and 7, each one of the vertically oriented external side wall members 200,202 of the conveyor belt guides 196,198 is respectively provided with an aperture 394, only one of which is visible, by means of which each one of the adjustment wheels 380 is externally accessible to operator personnel.

Continuing further, it is seen that the manually operable handle 376 is provided with a first clevis portion 396, and that the connection rod portion 384 of the adjustment link 374 is adapted to be interposed between the oppositely disposed, separated arms of the first clevis portion 396 of the manually operable handle 376 so that the connection rod portion 384 of the adjustment link 374 and the first clevis portion 396 of the manually operable handle 376 can be pivotally connected to each other. In order to achieve such a pivotal connection between the connection rod portion 384 of the adjustment link 374 and the first clevis portion 396 of the manually operable handle 376, the connection rod portion 384 of the adjustment link 374 is provided with a throughbore 398, and the oppositely disposed, separated arms of the first clevis portion 396 of the manually operable handle 376 are provided with throughbores 400,400. A linkage pin 402 is adapted to be inserted through the throughbores 400,400 of the first clevis portion 396 of the manually operable handle 376, as well as through the throughbore 398 of the connection rod portion 384 of the adjustment link 374, and a set screw 404 will be inserted through a throughbore 406 defined within the linkage pin 402 so as to be engaged within a recessed region 408 defined within an end face of the connection rod portion 384 of the adjustment link 374.

In a similar manner, it is seen that the manually operable handle 376 is provided with a second clevis portion 410, and that the force transmission link 378 comprises a connection rod portion 412 which is adapted to be interposed between the oppositely disposed, separated arms of the second clevis portion 410 of the manually operable handle 376 such that the connection rod portion 412 of the force transmission link 378 and the second clevis portion 410 of the manually operable handle 376 can likewise be pivotally connected to each other. In order to achieve such a pivotal connection between the connection rod portion 412 of the force transmission link 378 and the second clevis portion 410 of the manually operable handle 376, the connection rod portion 412 of the force transmission link 378 is provided with a throughbore 414, and the oppositely disposed, separated arms of the second clevis portion 410 of the manually operable handle 376 are provided with throughbores 416,416. A linkage pin 418 is adapted to be inserted through the bores 416,416 of the second clevis portion 410 of the manually operable handle 376, as well as through the throughbore 414 of the connection rod portion 412 of the force transmission link 378, and a set screw 420 will be inserted through a throughbore 422 defined within the linkage pin 418 so as to be engaged within a recessed region, not visible, defined within an end face of the connection rod portion 412 of the force transmission link 378.

It is lastly seen that the force transmission link 378 is also provided with a third clevis portion 424, and that the free end portion 426 of the linear linkage bar 372 is adapted to be interposed between the oppositely disposed, separated arms of the third clevis portion 424 of the force transmission link 378 such that the free end portion 426 of the linear linkage bar 372 and the third clevis portion 424 of the force transmission link 378 can also be pivotally connected to each other. In order to achieve such a pivotal connection between the free end portion 426 of the linear linkage bar 372 and the third clevis portion 424 of the force transmission link 378, the free end portion 426 of the linear linkage bar 372 is provided with a throughbore 428, and the oppositely disposed, separated arms of the third clevis portion 424 of the force transmission link 378 are provided with throughbores 430,430. A linkage pin 432 is adapted to be inserted through the bores 430,430 of the third clevis portion 424 of the force transmission link 378, as well as through the throughbore 428 of the free end portion 426 of the linear linkage bar 372, and a set screw 434 will be inserted through a throughbore 436 defined within the linkage pin 432 so as to be engaged within a recessed region, not visible, defined within an end face of the free end portion 426 of the linear linkage bar 372. It is to be noted that when the free end portion 426 of the linear linkage bar 372 is to be mated with the third clevis portion 424 of the force transmission link 378 and is to be operatively mounted upon the mounting plate 336, the free end portion 426 of the linear linkage bar 372 is inserted through a rectangularly configured aperture 438 defined within a third ear 440 of the mounting plate 336 such that the pivotal connection defined between the free end portion 426 of the linear linkage bar 372 and the third clevis portion 424 of the force transmission link 378 will be disposed within an internal portion of the mounting plate 336, that is, at a position interposed between the third ear 440 and the pair of ears 386,388.

In order to achieve a conveyor belt tension adjustment operation, it is initially noted that the manually operable handle 376 effectively forms an over-center locking mechanism with the force transmission link 378 relative to a linear axis effectively defined between the linear linkage bar 372 and the adjustment link 374. This can best be appreciated from FIG. 2 wherein it can be seen that when each one of the tension roller bracket subassemblies 22 is disposed at its TENSIONED position, the manually operable handle 376 and the force transmission link 378 will be disposed at an angular orientation with respect to each other as a result of the pivot pin section 418 of the pivotal connection defined between the connection rod portion 412 of the force transmission link 378 and the second clevis portion 410 of the manually operable handle 376 being disposed at its inward position, beyond the linear axis effectively defined between the linear linkage bar 372 and the adjustment link 374, so as to be disposed against the mounting plate 336. In such a state or position, a predetermined amount of tension is impressed upon each one of the conveyor belts 192,194 by means of its respective set of idler rollers 350,352.

If the tension within the conveyor belts 192,194 is not in fact at a predetermined desirable level, the manually operable handle 376, which is externally accessible by operator personnel through means of a substantially elongated aperture 442 defined within each one of the vertically oriented external side wall members 200,202 of the conveyor belt guides 196, 198, is pulled outwardly to its RELEASED position such that the pivot pin section 418 of the pivotal connection defined between the connection rod portion 412 of the force transmission link 378 and the second clevis portion 410 of the manually operable handle 376 will now be disposed at its outward position upon the opposite side of the linear axis effectively defined between the linear linkage bar 372 and the adjustment link 374. At this point in time, the linear linkage bar 372 will have been moved slightly toward the left as viewed within FIG. 9 so as to likewise move the idler rollers 350,352 slightly toward the left thereby effectively relieving the tension impressed upon the respective one of the conveyor belts 192,194. The rotary adjustment wheel 380 can now be rotated in either one its two opposite angular directions, that is, either in the clockwise or in the counterclockwise direction, in order to effectively move the externally threaded rod portion 382 of the adjustment link 374 in either one of its two opposite linear directions. In this manner, the effective length of the linkage connection, defined between the adjustment link 374 and the linear linkage. bar 372 upon which the pair of idler rollers 350,352 are mounted by means of the idler roller support shaft 362, can be increased or decreased so as to, in turn, increase or decrease the amount of tension effectively impressed upon the particular conveyor belt 192,194 by means of the pair of idler rollers 350,352 when the manually operable handle 376 is again moved to and locked at its TENSIONED position. It is also noted that when the manually operable handle 376 is moved to its RELEASED position so as to effectively relieve the tension within the conveyor belts 192,194, the conveyor belts 192,194 may be easily and readily removed, without the use of any special tools, from the conveyor belt guides 196,198 for servicing, replacement, or the like.

Figure 10:
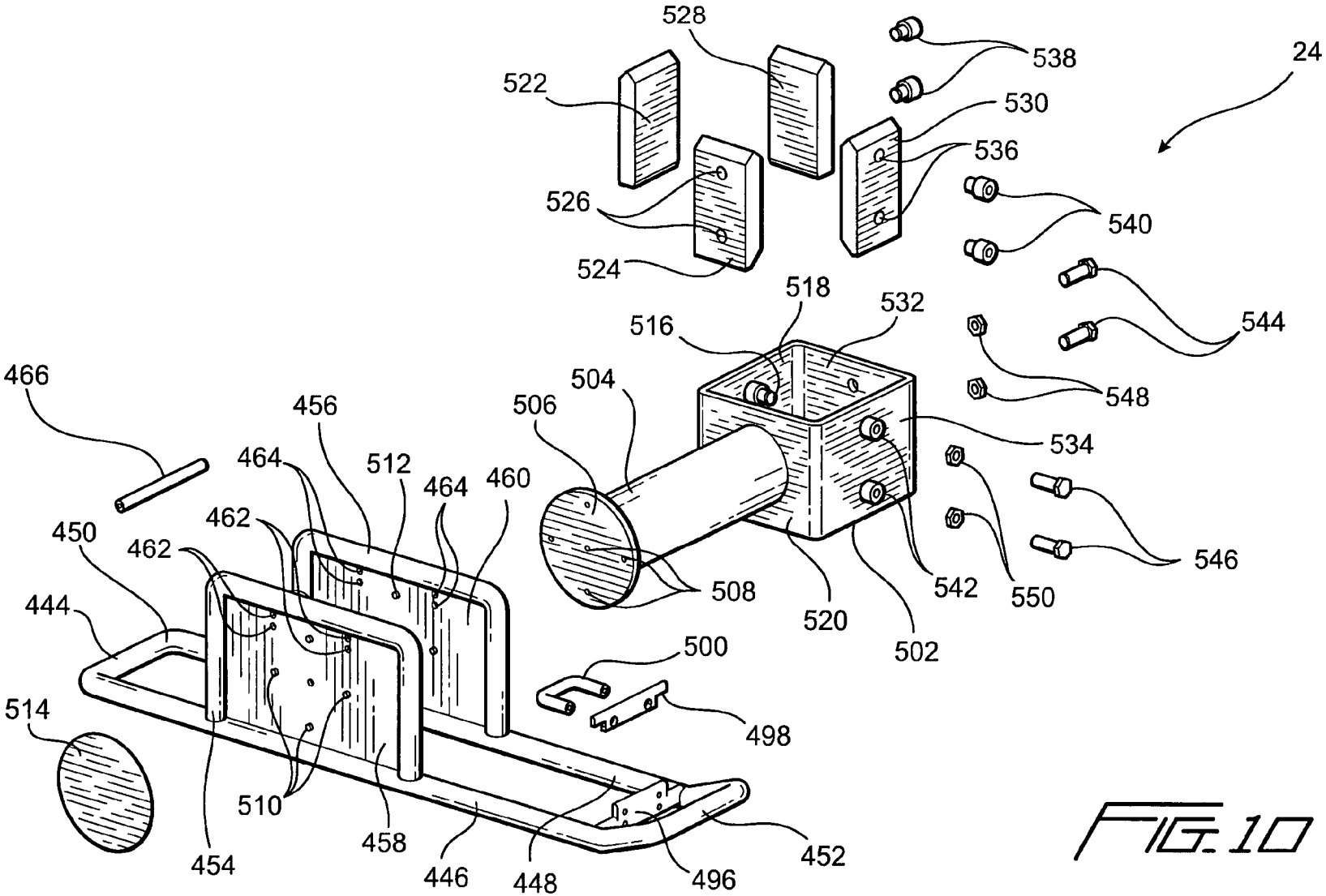
FIG. 10 is an enlarged and exploded perspective detailed view of the head subassembly of the new and improved case sealer assembly as disclosed within FIG. 2.

With reference being made to FIG. 10, the head subassembly 24 of the new and improved case sealer assembly or apparatus 10 will now be described. The head subassembly 24 is adapted to be adjustably mounted upon the vertically upstanding mast member 62 of the mast subassembly 26 so as to, in turn, positionally adjust the disposition of the upper case sealer tape cartridge, not shown, with respect to, for example, conveyor belts 192,194 in order to properly position the upper case sealer tape cartridge, not shown, with respect to, for example, the upper surface portion of the carton or case being conveyed through the new and improved case sealer assembly or apparatus 10 by means of the conveyor belts 192, 194. More particularly, it is seen that the head subassembly 24 is seen to comprise an upper case sealer tape cartridge framework 444 which is fabricated from round tubular or rod stock. The upper case sealer tape cartridge framework 444 is also seen to have a substantially rectangular configuration comprising a pair of oppositely disposed, longitudinally extending, relatively long, side frame members 446,448 and a pair of oppositely disposed, transversely extending, relatively short, end frame members 450,452. The pair of oppositely disposed, longitudinally extending, relatively long, side frame members 446,448 respectively have vertically upstanding enclosure type frame members 454,456 integrally connected thereto at substantially longitudinally central regions thereof, and a pair of mounting plates 458,460 are respectively mounted within the enclosure type frame members 454,456. It is further seen that first sets of four apertures 462,464 are respectively provided within the upper regions of the mounting plates 458,460, and that a pivot pin 466, upon which the upper case sealer tape cartridge, not shown, is to be pivotally mounted, is adapted to be mounted within any one of the four apertures 462,464 upon each one of the mounting plates 458,460 depending upon the particular style, configuration, or size of the particular upper case sealer tape cartridge being employed.

Along these lines, and reverting back to FIGS. 1, 3, and 4, it is seen that, in connection with the lower case sealer tape cartridge housing 224, vertically oriented wall members 468, 470, which are integrally connected to the horizontally oriented mounting plates 230,232 of the lower case sealer tape cartridge housing 224, are respectively provided with four sets of upper and lower, longitudinally spaced apertures 472, 474,476,478 and 480,482,484,486. It has been noted hereinbefore that various ones of the subassemblies of the new and improved case sealer assembly or apparatus 10, such as, for example, the side rail subassembly 16, the conveyor belt drive subassembly 18, the motor starter subassembly 20, and the pair of tension roller bracket subassemblies 22,22, are adapted to be mounted upon the tube frame subassembly 12 in reversed positions so as to accommodate particular manufacturing plant processing line directions, and accordingly, when the new and improved case sealer assembly or apparatus 10 is erected as illustrated within FIG. 1 wherein the incoming cases or cartons are conveyed in the conveying direction CD extending from the right toward the left, the lower case sealer tape cartridge, not shown, will be mounted upon the lower case sealer tape cartridge housing 224 by means of fastener assemblies which will be affixed within, for example, the upper set of apertures 472,476 and 480,484.

To the contrary, when the various subassemblies, for example, 16-22 are to be reversed, the lower case sealer tape cartridge, not shown, will be mounted upon the lower case sealer tape cartridge housing 224 by means of fastener assemblies which will be affixed within the other upper set of apertures 474,478 and 482,486. It is further noted that the reason that upper and lower sets of the apertures 472-486 are provided upon the lower case sealer tape cartridge housing 224 is to also enable the case sealer assembly or apparatus 10 to accommodate differently sized lower case sealer tape cartridges. In connection with the actual fastener assemblies for affixing the lower case sealer tape cartridge, not shown, within any one of the apertures 472-486, the fastener assemblies are illustrated within, for example, FIGS. 3 and 4, wherein all of the fastener assemblies are identical and comprise a bolt member 488, a stand-off 490, a washer 492, and a hex nut 494.

Reverting back to FIG. 10, it is seen that the upper case sealer tape cartridge framework 444 also comprises a mounting bracket 496 which is fixedly mounted within the vicinity of the end frame member 452 so as to span and interconnect the side frame members 446,448. A cartridge stop 498 and a load bracket 500 are adapted to be bolted to the mounting bracket 496 so as to engage and retain the end of the upper case sealer tape cartridge, not shown, which is disposed opposite the end of the upper case sealer tape cartridge, not shown, which is pivotally mounted upon the pivot pin 466. Continuing further, a substantially square-shaped sleeve member 502 is adapted to be slidably mounted upon the vertically upstanding mast member 62 so as to adjust the disposition of the upper case sealer tape cartridge, not shown, with respect to, for example, conveyor belts 192,194 in order to properly position the upper case sealer tape cartridge, not shown, with respect to, for example, the upper surface portion of the case or carton being conveyed through the new and improved case sealer assembly or apparatus 10 by means of the conveyor belts 192,194, and it is seen that the substantially square-shaped sleeve member 502 has a tubular or rod-shaped mounting arm 504 fixedly mounted upon an external side wall portion thereof. The free or distal end portion of the tubular or rod-shaped mounting arm 504 has a circular mounting disc or plate 506 fixedly mounted thereon, and it is noted that the mounting disc or plate 506 is provided with a set of five apertures 508. In a similar manner, the vertically upstanding mounting plates 458,460 are likewise respectively provided with a set of five apertures 510,512. In this manner, when the upper case sealer tape cartridge framework 444 is to be fixedly mounted upon the mounting disc or plate 506 of the head subassembly 24 in the illustrated orientation, suitable bolt fasteners are inserted through the apertures 512,508 of the mounting plate 460 and the mounting disc 506, while a cover plate 514 may be fastened upon the external surface portion of the mounting plate 458. If the upper case sealer tape cartridge framework 444 is to be mounted upon the mounting disc 506 in accordance with a reversed orientation, as when the other ones of the aforenoted subassemblies 16-22 are to be mounted in their reversed modes upon the case sealer assembly or apparatus 10, the bolt fasteners can be removed from the mounting plates 460,506, the cover plate 514 can be removed from the mounting plate 458, the upper case sealer tape cartridge framework 444 can then be turned around or reversed in its orientation, the mounting plate 458 can then be fixedly mounted upon the mounting plate or disc 506 by means of the bolt fasteners, and the cover plate 514 can be mounted upon the external surface portion of the mounting plate 460.

In order to actually affix the substantially square-shaped sleeve member 502 in a vertically slidable and adjustable manner upon the vertically upstanding mast member 62, it is further seen that the substantially square-shaped sleeve member 502 has a pair of vertically spaced studs 516, only one of which is visible, projecting outwardly from the internal surface portion of the side wall 518, and a similar pair of vertically spaced studs, not visible, are likewise disposed upon the internal surface portion of the side wall 520. A first pair of clamping blocks 522,524 are adapted to be respectively mounted upon the studs 516 projecting outwardly from the internal surface portions of the side walls 518,520, and as can best be seen in connection with the static clamping block 524, the rear or outer surface portions of the static clamping blocks 522,524 are respectively provided with pairs of vertically spaced blind bores 526, although only the bores 526 upon the rear surface portion of clamping block 524 are visible. In this manner, the first pair of clamping blocks 522,524 can be fixedly mounted upon the studs 516 through means of, for example, an interference fit. In a similar manner, a second pair of clamping blocks 528,530 are adapted to be mounted internally within the substantially square-shaped sleeve member 502, however, the second pair of clamping blocks 528,530 are not to be fixedly mounted upon the side walls 532,534 of the substantially square-shaped sleeve member 502. To the contrary, the rear or outer surface portions of the second pair of clamping blocks 528,530 are likewise respectively provided with a pair of vertically spaced blind bores 536, only the bores 536 upon the clamping block 530 being visible, and a pair of internally threaded stand-offs 538,540 are respectively mounted within the vertically spaced blind bores 536 of the clamping blocks 528,530 by means of, for example, an interference fit.

In addition, pairs of vertically spaced, internally threaded stand-offs or bosses 542 are fixedly mounted upon the external surface portions of the side walls 532,534, only the stand-offs or bosses 542 disposed upon the side wall 534 being visible, and pairs of externally threaded bolt fasteners 544, 546, having jam nuts 548,550 operatively associated therewith, are adapted to be threadedly engaged within the internally threaded stand-offs or bosses 542, disposed upon the side walls 532,534 of the substantially square-shaped sleeve member 502, while the internally threaded stand-offs 538, 540 are adapted to be fixedly mounted upon the distal end portions of the bolt fasteners 544,546. In this manner, as the threaded bolt fasteners 544,546 are threaded inwardly and outwardly with respect to the internally threaded stand-offs or bosses 542, the second pair of clamping blocks 528,530 can be dynamically moved into and out of engagement with side wall portions of the vertically upstanding mast member 62 whereby the first and second pairs of static and dynamic clamping blocks 522,524,528,530 will cooperate together so as to effectively clamp or release the respective external side wall portions of the vertically upstanding mast member 62 in order to either fixedly secure the substantially square-shaped sleeve member 502, and therefore the entire head subassembly 24, at any predetermined position upon the vertically upstanding mast member 62, or alternatively, to release the substantially square-shaped sleeve member 502, and the entire head subassembly 24, from a predetermined position upon the vertically upstanding mast member 62 so as to permit the head subassembly 24 to be adjustably moved to another predetermined position upon the vertically upstanding mast member 62.

With reference lastly again being made to FIG. 11, the means for controlling the vertical movement of the substantially square-shaped sleeve member 502, and therefore the vertical movement of the entire head subassembly 24, upon the vertically upstanding mast member 62, will now be described. More particularly, a mounting plate, block, or bracket, not shown, but having an aperture formed therein, is provided upon the external surface of the side wall 532 of the substantially square-shaped sleeve member 502 of the head subassembly 24, and a rod nut 552 is adapted to be mated with such mounting plate, block, or bracket, not shown, such that a lower annular flanged portion 554 of the rod nut 552 will engage the undersurface portion of the mounting plate, block, or bracket, not shown, while an axially central portion 556 of the rod nut 552 will be disposed within the aperture defined within the mounting plate, block, or bracket, not shown. Still further, an axially uppermost portion 558 of the rod nut 552 will effectively pass through the aperture defined within the mounting plate, block, or bracket, not shown, and a clamping or locking collar 560 is adapted to be fixedly secured to the uppermost portion 558 of the rod nut 552 by means of a set screw, not shown, so as to thereby also engage the upper surface portion of the mounting plate, block, or bracket, not shown. In this manner, the rod nut 552 is fixedly mounted upon the mounting plate, block, or bracket, not shown, which is, in turn, fixedly mounted upon the external surface of the side wall 532 of the substantially square-shaped sleeve member 502 of the head subassembly 24.

Continuing further, a vertically oriented, externally threaded rod 562 has its lower end portion threadedly engaged within the rod nut 552 so as to pass therethrough, and a set collar 564 is fixedly mounted upon the lower terminal end portion of the threaded rod 562 such that if the threaded rod 562 is moved upwardly within and with respect to the rod nut 552 through an extreme amount of travel, eventually the set collar 564 will come into contact with the annular flanged portion 554 of the rod nut 552 so as to effectively prevent the lower terminal end portion of the threaded rod 562 from being threadedly disconnected from the rod nut 552. The upper end portion of the threaded rod 562 is provided with a diametrically stepped configuration comprising a non-threaded uppermost end section 566 and a threaded section 568 which is axially interposed between the non-threaded uppermost end section 566 and the main section of the threaded rod 562. The vertically upstanding mast member 62 is provided with a horizontally oriented mounting plate 570, and a counterbored aperture 572 is formed within the mounting plate 570.

A first washer 574 is adapted to be mounted over the upper end portion of the threaded rod 562 so as to be seated upon the annular shoulder portion defined between the main section of the threaded rod 562 and intermediate threaded rod section 568, and a bearing member 576 is adapted to be seated within the counterbored aperture 572. The intermediate threaded rod section 568 will project outwardly from the counterbored aperture 572 so as to be disposed above the counterbored aperture 572 and the bearing member 576 disposed therewithin, and a second washer 578 is adapted to be placed over the intermediate threaded rod section 568 so as to be disposed in contact with the bearing member 576. Lastly, a pair of jam nuts 580, 580 are threadedly secured upon the intermediate threaded rod section 568 so as to fixedly secure the various components together. Lastly, a manually operable control handle 582 is disposed upon the non-threaded upper-most end section 566 of the threaded rod 562, and a dowel pin 584 is inserted through the base section of the control handle 582 as well as through the non-threaded uppermost end section 566 of the threaded rod 562. In this manner, rotation of control handle 582 in either the clockwise or counterclockwise direction will cause the threaded rod 562 to threadedly translate within the rod nut 552 thereby causing the substantially square-shaped sleeve member 502 of the head subassembly 24 to be vertically moved with respect to the vertically upstanding mast member 62 so as to position the substantially square-shaped sleeve member 502 of the head subassembly 24, and the upper case sealer tape cartridge, not shown, at a predetermined elevational position with respect to the cases or cartons being conveyed by means of the conveyor belts 192, 194.

Thus, it may be seen that there has been provided a new and improved case sealer assembly or apparatus which comprises, for example, frame members which are fabricated from round tubular or rod stock. In this manner, water will tend to readily drain from such structures or at least tend not to accumulate upon such structures in order to prevent the harboring of bacteria within such regions of the assembly or apparatus, or to prevent or foster the growth of bacteria within such regions of the case sealer assembly or apparatus. In addition, the new and improved case sealer assembly or apparatus has knockdown capabilities, as a result of comprising a plurality of subassemblies which are readily disassembled from one another, in order to facilitate the cleaning of the various subassemblies, as well as the overall case sealer assembly or apparatus, and in addition, to facilitate maintenance or replacement of component parts. It is lastly noted that various subassemblies of the new and improved case sealer assembly or apparatus are reversibly mounted upon the main tube frame subassembly of the case sealer assembly or apparatus so as to effectively render the case sealer assembly or apparatus operative in either one of two different directions as may be preferred in accordance with a particular manufacturing plant processing line.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A case sealer assembly for sealing cases, comprising:

a tube frame subassembly comprising a plurality of frame members;

a side rail subassembly mounted upon said tube frame subassembly and comprising a pair of oppositely disposed side rail members cooperating together for accommodating and guiding cases to be sealed by said case sealer assembly, wherein said pair of oppositely disposed side rail members are adjustably mounted upon said tube frame subassembly so as to accommodate and guide differently sized cases to be sealed by said case sealer assembly, and wherein further, said pair of oppositely disposed side rail members are interconnected together such that positional adjustment of one of said pair of oppositely disposed side rail members automatically positionally adjusts the other one of said pair of oppositely disposed side rail members;

means for mounting a lower case sealer tape cartridge housing, for containing sealing tape, upon said tube frame subassembly;

conveyor belt means, mounted upon said tube frame subassembly, for conveying cases past said lower case sealer tape cartridge housing so as to permit the cases to be sealed by the sealing tape contained within said lower case sealer tape cartridge housing; and fastener means mounted upon said tube frame subassembly and said conveyor belt means for permitting said conveyor belt means to be removably mounted upon said tube frame subassembly such that said conveyor belt means can be positioned upon said tube frame subassembly in either one of two oppositely disposed orientations whereby said conveyor belt means can convey the cases to be sealed in either one of two opposite directions.

2. The case sealer assembly as set forth in claim 1, further comprising:

oppositely oriented fastener means mounted upon said tube frame subassembly for permitting said side rail subassembly, comprising said pair of oppositely disposed side rail members, to be mounted upon said tube frame subassembly in one of two oppositely disposed orientations when said conveyor belt means is positioned upon said tube frame subassembly in either one of said two oppositely disposed orientations so as to permit said conveyor belt means to convey the cases to be sealed in either one of said two opposite directions.

3. The case sealer assembly as set forth in claim 2, wherein:

said oppositely oriented fastener means mounted upon said tube frame subassembly for permitting said side rail subassembly, comprising said pair of oppositely disposed side rail members, to be mounted upon said tube frame subassembly in one of two oppositely disposed orientations comprises pintle structures having externally threaded stub shafts projecting outwardly therefrom;

said pair of oppositely disposed side rail members comprise collar means for disposition upon said pintle structures of said tube frame assembly; and internally threaded manually manipulable knob members are adapted to be threadedly engaged with said externally threaded stub shafts of said tube frame subassembly so as to retain said collar means of said pair of oppositely disposed side rail members upon said pintle structures of said tube frame subassembly.

4. The case sealer assembly as set forth in claim 1, further comprising:

means for removably mounting said conveyor belt means upon said tube frame subassembly such that said conveyor belt means can be manually mounted upon and removed from said tube frame subassembly without the need for tools.

5. The case sealer assembly as set forth in claim 1, further comprising:

means for removably mounting said side rail subassembly, comprising said pair of oppositely disposed side rail members, upon said tube frame subassembly such that said pair of oppositely disposed side rail members can be manually mounted upon and removed from said tube frame subassembly without the need for tools.

6. The case sealer assembly as set forth in claim 1, wherein:

said conveyor belt means comprises at least one conveyor belt, at least one drive roller operatively engaged with said at least one conveyor belt, at least one idler roller operatively engaged with said at least one conveyor belt, and means mounted upon said tube frame subassembly for adjusting the disposition of said at least one idler roller with respect to said at least one conveyor belt so as to adjust the tension level within said at least one conveyor belt.

7. The case sealer assembly as set forth in claim 6, wherein said means mounted upon said tube frame subassembly for adjusting the disposition of said at least one idler roller with respect to said at least one conveyor belt so as to adjust the tension level within said at least one conveyor belt comprises:

an adjustment wheel; and linkage means operatively connecting said adjustment wheel to said at least one idler roller.

8. The case sealer assembly as set forth in claim 7, wherein:

said linkage means comprises an over-center locking mechanism movable between a RELEASED position at which said adjustment wheel can be operated so as to adjust the length of said linkage means to a predetermined value, and a TENSIONED position at which said linkage means, having said predetermined adjusted length value, will force said at least one idler roller into operative engagement with said at least one conveyor belt so as to impress said adjusted tension level upon said at least one conveyor belt.

9. A case sealer assembly for sealing cases, comprising:

a tube frame subassembly comprising a plurality of frame members for supporting said case sealer assembly upon a floor surface;

a side rail subassembly mounted upon said tube frame subassembly and comprising a pair of oppositely disposed side rail members cooperating together for accommodating and guiding cases to be sealed by said case sealer assembly, wherein said pair of oppositely disposed side rail members are adjustably mounted upon said tube frame subassembly so as to accommodate and guide differently sized cases to be sealed by said case sealer assembly, and wherein further, said pair of oppositely disposed side rail members are interconnected together such that positional adjustment of one of said pair of oppositely disposed side rail members automatically positionally adjusts the other one of said pair of oppositely disposed side rail members;

means for mounting a lower case sealer tape cartridge housing, for containing sealing tape, upon said tube frame subassembly; and conveyor belt means, mounted upon said tube frame subassembly, for conveying cases between said pair of side rail members and past said lower case sealer tape cartridge housing so as to permit the cases to be sealed by the sealing tape contained within said lower case sealer tape cartridge housing;

wherein all of said plurality of frame members, comprising said tube frame subassembly, and said pair of oppositely disposed side rail members comprising said side rail subassembly, comprise round stock so as to permit water to readily drain therefrom and not accumulate thereon when said case sealer assembly is subjected to a washdown cleaning procedure.

10. The case sealer assembly as set forth in claim 9, further comprising:

means for removably mounting said conveyor belt means upon said tube frame subassembly such that said conveyor belt means can be manually mounted upon and removed from said tube frame subassembly without the need for tools.

11. The case sealer assembly as set forth in claim 9, further comprising:

means for removably mounting said side rail subassembly upon said tube frame subassembly such that said pair of oppositely disposed side rail members can be manually mounted upon and removed from said tube frame subassembly without the need for tools.

12. The case sealer assembly as set forth in claim 9, further comprising:

oppositely oriented fastener means mounted upon said tube frame subassembly for permitting said side rail subassembly to be mounted upon said tube frame subassembly in one of two oppositely disposed orientations when said conveyor belt means is positioned upon said tube frame subassembly in either one of said two oppositely disposed orientations so as to permit said conveyor belt means to convey the cases to be sealed in either one of said two opposite directions.

13. The case sealer assembly as set forth in claim 12, wherein:

said oppositely oriented fastener means mounted upon said tube frame subassembly for permitting said side rail subassembly, comprising said pair of oppositely disposed side rail members, to be mounted upon said tube frame subassembly in one of two oppositely disposed orientations comprises pintle structures having externally threaded stub shafts projecting outwardly therefrom;

said pair of oppositely disposed side rail members comprise collar means for disposition upon said pintle structures of said tube frame assembly; and internally threaded manually manipulable knob members are adapted to be threadedly engaged with said externally threaded stub shafts of said tube frame subassembly so as to retain said collar means of said pair of oppositely disposed side rail members upon said pintle structures of said tube frame subassembly.

14. The case sealer assembly as set forth in claim 9, further comprising:

means for removably mounting said conveyor belt means upon said tube frame subassembly such that conveyor belt means can be positioned upon said tube frame subassembly in either one of two oppositely disposed orientations whereby said conveyor belt means can convey the cases to be sealed in either one of two opposite directions.

15. A case sealer assembly for sealing cases, comprising:

a tube frame subassembly comprising a plurality of frame members;

a lower case sealer tape cartridge housing for mounting a tape cartridge, for containing sealing tape, upon said tube frame subassembly;

conveyor belt means, mounted upon said tube frame subassembly, for conveying cases past said at least one tape cartridge so as to permit the cases to be sealed by the sealing tape contained within said at least one tape cartridge;

a side rail subassembly mounted upon said tube frame subassembly and comprising a pair of oppositely disposed side rail members cooperating together for accommodating and guiding cases to be sealed by said case sealer assembly, wherein said pair of oppositely disposed side rail members are adjustably mounted upon said tube frame subassembly so as to accommodate and guide differently sized cases to be sealed by said case sealer assembly, and wherein further, said pair of oppositely disposed side rail members are interconnected together such that positional adjustment of one of said pair of oppositely disposed side rail members automatically positionally adjusts the other one of said pair of oppositely disposed side rail members;

means for removably mounting said side rail subassembly, comprising said pair of oppositely disposed side rail members, upon said tube frame subassembly such that said pair of oppositely disposed side rail members can be manually mounted upon and removed from said tube frame subassembly without the need for tools.

16. The case sealer assembly as set forth in claim 15, further comprising:

means for removably mounting said conveyor belt means upon said tube frame subassembly such that conveyor belt means can be positioned upon said tube frame subassembly in either one of two oppositely disposed orientations whereby said conveyor belt means can convey the cases to be sealed in either one of two opposite directions.

17. The case sealer assembly as set forth in claim 15, wherein:

said conveyor belt means comprises at least one conveyor belt, at least one drive roller operatively engaged with said at least one conveyor belt, at least one idler roller operatively engaged with said at least one conveyor belt, and means mounted upon said tube frame subassembly for adjusting the disposition of said at least one idler roller with respect to said at least one conveyor belt so as to adjust the tension level within said at least one conveyor belt.

18. The case sealer assembly as set forth in claim 17, wherein said means mounted upon said tube frame subassembly for adjusting the disposition of said at least one idler roller with respect to said at least one conveyor belt so as to adjust the tension level within said at least one conveyor belt comprises:

an adjustment wheel; and linkage means operatively connecting said adjustment wheel to said at least one idler roller.

19. The case sealer assembly as set forth in claim 18, wherein:

said linkage means comprises an over-center locking mechanism movable between a RELEASED position at which said adjustment wheel can be operated so as to adjust the length of said linkage means to a predetermined value, and a TENSIONED position at which said linkage means, having said predetermined adjusted length value, will force said at least one idler roller into operative engagement with said at least one conveyor belt so as to impress said adjusted tension level upon said at least one conveyor belt.

20. The case sealer assembly as set forth in claim 15, further comprising:

oppositely oriented fastener means mounted upon said tube frame subassembly for permitting said side rail subassembly to be mounted upon said tube frame subassembly in one of two oppositely disposed orientations when said conveyor belt means is positioned upon said tube frame subassembly in either one of said two oppositely disposed orientations so as to permit said conveyor belt means to convey the cases to be sealed in either one of said two opposite directions.

21. The case sealer assembly as set forth in claim 20, wherein:

said oppositely oriented fastener means mounted upon said tube frame subassembly for permitting said side rail subassembly, comprising said pair of oppositely disposed side rail members, to be mounted upon said tube frame subassembly in one of two oppositely disposed orientations comprises pintle structures having externally threaded stub shafts projecting outwardly therefrom;

said pair of oppositely disposed side rail members comprise collar means for disposition upon said pintle structures of said tube frame assembly; and internally threaded manually manipulable knob members are adapted to be threadedly engaged with said externally threaded stub shafts of said tube frame subassembly so as to retain said collar means of said pair of oppositely disposed side rail members upon said pintle structures of said tube frame subassembly.

22. The case sealer assembly as set forth in claim 15, further comprising:

means for removably mounting said conveyor belt means upon said tube frame subassembly such that said conveyor belt means can be manually mounted upon and removed from said tube frame subassembly without the need for tools.

* * * * *